US011420092B2

(12) United States Patent
Bayerlein et al.

(10) Patent No.: US 11,420,092 B2
(45) Date of Patent: Aug. 23, 2022

(54) MOTORIZED TREADMILL WITH MOTOR BRAKING MECHANISM AND METHODS OF OPERATING SAME

(71) Applicant: Woodway USA, Inc., Waukesha, WI (US)

(72) Inventors: Douglas G. Bayerlein, Waukesha, WI (US); Nicholas Oblamski, Waukesha, WI (US); Vance E. Emons, Waukesha, WI (US)

(73) Assignee: Woodway USA, Inc., Waukesha, WI (US)

( * ) Notice: Subject to any disclaimer, the term of this patent is extended or adjusted under 35 U.S.C. 154(b) by 20 days.

(21) Appl. No.: 17/164,117

(22) Filed: Feb. 1, 2021

(65) Prior Publication Data

US 2021/0178221 A1 Jun. 17, 2021

Related U.S. Application Data

(63) Continuation of application No. 16/363,273, filed on Mar. 25, 2019, now Pat. No. 10,905,914, which is a (Continued)

(51) Int. Cl.
*A63B 22/02* (2006.01)
*A63B 71/06* (2006.01)
(Continued)

(52) U.S. Cl.
CPC ..... *A63B 22/025* (2015.10); *A63B 21/0053* (2013.01); *A63B 21/0054* (2015.10);
(Continued)

(58) Field of Classification Search
CPC ..... A63B 22/025; A63B 21/0058; A63B 71/0054; A63B 71/0622; A63B 21/0053;
(Continued)

(56) References Cited

U.S. PATENT DOCUMENTS 8,308 A 8/1851 Seymour
26,914 A * 1/1860 Meldrum ..... D06F 45/28 68/267
(Continued)

FOREIGN PATENT DOCUMENTS

CN 3201120 9/2001
CN 2860541 1/2007
(Continued)

OTHER PUBLICATIONS

Woodway, "The Woodway LOKO Owners Manual", S55-70 E Standard Manual, Sep. 26, 2006, 47 pages.
(Continued)

*Primary Examiner* — Garrett K Atkinson
(74) *Attorney, Agent, or Firm* — Foley & Lardner LLP

(57) ABSTRACT

A treadmill includes a frame; a running belt configured to move relative the frame; and a motor coupled to the running belt. The motor is operable in a plurality of user controlled operating modes. In a first operating mode, the force of rotation of the running belt is provided by a user of the treadmill. In a second operating mode, the motor applies a desired braking force to resist rotation of the running belt. In a third operating mode, the motor applies a torque output to the running belt based on a force exerted on the running belt by a user of the treadmill.

20 Claims, 15 Drawing Sheets

Related U.S. Application Data continuation of application No. 15/640,180, filed on Jun. 30, 2017, now Pat. No. 10,238,911.

(60) Provisional application No. 62/357,765, filed on Jul. 1, 2016.

(51) Int. Cl.

| | |
|---|---|
| ***A63B 21/005*** | (2006.01) |
| ***A63B 22/00*** | (2006.01) |
| ***A63B 23/04*** | (2006.01) |
| ***A63B 71/00*** | (2006.01) |

(52) U.S. Cl.

CPC ..... *A63B 21/0058* (2013.01); *A63B 22/0023* (2013.01); *A63B 22/02* (2013.01); *A63B 22/0235* (2013.01); *A63B 22/0285* (2013.01); *A63B 23/04* (2013.01); *A63B 71/0054* (2013.01); *A63B 71/0622* (2013.01); *A63B 2022/0278* (2013.01); *A63B 2071/0683* (2013.01); *A63B 2220/30* (2013.01); *A63B 2220/54* (2013.01); *A63B 2220/803* (2013.01); *A63B 2230/015* (2013.01); *A63B 2230/045* (2013.01); *A63B 2230/06* (2013.01)

(58) Field of Classification Search

CPC . A63B 22/0023; A63B 22/02; A63B 22/0235; A63B 22/0285; A63B 23/04; A63B 21/0054; A63B 2230/06; A63B 2022/0278; A63B 2071/0683; A63B 2220/30; A63B 2220/54; A63B 2220/803; A63B 2230/045; A63B 2230/015

See application file for complete search history.

(56) References Cited

U.S. PATENT DOCUMENTS 83,844 A * 11/1868 Goucher ..... B30B 9/241 100/153
104,534 A * 6/1870 Ashe ..... A43B 13/39 36/22 R
111,018 A * 1/1871 Thompson ..... F16L 41/06 285/180
118,030 A * 8/1871 Lovegrove ..... F28G 7/00 122/379
144,224 A * 11/1873 Potter ..... B61L 11/02 246/349
144,225 A * 11/1873 Purple ..... B07B 1/20 209/283
171,353 A * 12/1875 Conway ..... B25B 13/48 81/120
179,789 A * 7/1876 Hedges ..... B02C 7/06 241/248
219,439 A 9/1879 Blend
254,293 A * 2/1882 Edleblute ..... B62C 5/00 278/105
314,674 A * 3/1885 Hubbard ..... B21D 11/085 72/470
374,811 A * 12/1887 Savage ..... B24B 23/024 451/346
411,986 A 10/1889 Frazeur et al.
641,424 A 1/1900 Taitel et al.
759,296 A 5/1904 Morairty
767,221 A 8/1904 Hagen
783,769 A 2/1905 Wright
931,394 A 8/1909 Day
1,016,729 A * 2/1912 Barrett ..... A63B 22/02 482/54
1,211,765 A 1/1917 Schmidt
2,117,957 A 5/1938 Heller
2,399,915 A 5/1946 Drake
2,512,911 A 6/1950 Benice
2,842,365 A 7/1958 Kelley
3,637,206 A 1/1972 Chickering, III
3,642,279 A 2/1972 Cutter
3,728,261 A 4/1973 Mitacek
3,870,297 A 3/1975 Elder
3,968,543 A 7/1976 Shino et al.
4,334,676 A 6/1982 Schonenberger
4,389,047 A 6/1983 Hall
4,406,451 A 9/1983 Gaetano
4,544,152 A 10/1985 Taitel
4,548,405 A 10/1985 Lee et al.
4,576,352 A 3/1986 Ogden
4,614,337 A 9/1986 Schonenberger
4,635,928 A 1/1987 Ogden et al.
4,659,074 A 4/1987 Taitel et al.
4,726,581 A 2/1988 Chang
4,886,266 A 12/1989 Trulaske
4,938,469 A 7/1990 Crandell
5,018,343 A 5/1991 Finke
5,031,901 A 7/1991 Saarinen
5,044,470 A 9/1991 Nicholas
5,094,447 A 3/1992 Wang
5,145,480 A 9/1992 Wang
5,162,988 A 11/1992 Semerau et al.
D333,887 S 3/1993 Dowler
5,242,339 A 9/1993 Thornton
5,290,205 A 3/1994 Densmore et al.
5,310,392 A 5/1994 Lo
5,318,487 A 6/1994 Golen et al.
5,368,532 A 11/1994 Farnet
5,378,213 A 1/1995 Quint
5,411,279 A 5/1995 Magid
5,411,455 A 5/1995 Haber et al.
5,431,612 A 7/1995 Holden
5,470,293 A 11/1995 Schonenberger
5,492,517 A 2/1996 Bostic et al.
5,538,489 A 7/1996 Magid
5,575,740 A 11/1996 Piaget et al.
5,577,598 A 11/1996 Schoenenberger
5,607,376 A 3/1997 Magid
5,643,144 A 7/1997 Trulaske
5,669,856 A 9/1997 Liu
5,683,332 A * 11/1997 Watterson ..... A63B 22/0023 482/51
5,688,209 A 11/1997 Trulaske et al.
5,709,632 A 1/1998 Socwell
5,856,736 A 1/1999 Rotunda et al.
5,887,579 A 3/1999 Eriksson et al.
5,891,830 A 4/1999 Koltermann et al.
5,897,461 A * 4/1999 Socwell ..... A63B 22/0012 482/54
6,042,514 A 3/2000 Abelbeck
6,053,848 A * 4/2000 Eschenbach ..... A63B 22/02 482/51
6,056,072 A 5/2000 Koltermann et al.
6,095,952 A 8/2000 Ali et al.
6,146,315 A 11/2000 Schonenberger
6,152,854 A * 11/2000 Carmein ..... A63B 22/025 482/4
6,180,210 B1 1/2001 Debus
6,328,676 B1 12/2001 Alessandri
6,334,836 B1 1/2002 Segasby
6,334,839 B1 * 1/2002 Lim ..... A63B 22/02 482/51
6,348,025 B1 2/2002 Schonenberger
6,387,015 B1 5/2002 Watson
6,454,679 B1 9/2002 Radow
6,468,189 B2 10/2002 Alessandri
6,500,097 B1 12/2002 Hall
6,616,578 B2 9/2003 Alessandri
6,652,424 B2 11/2003 Dalebout
D484,554 S 12/2003 Hellman et al.
6,740,009 B1 5/2004 Hall
6,761,667 B1 7/2004 Cutler et al.
6,824,502 B1 * 11/2004 Huang ..... A63B 22/0023 482/54
6,837,830 B2 * 1/2005 Eldridge ..... A63B 21/225 482/54
6,893,382 B1 5/2005 Moon et al.

(56) References Cited

U.S. PATENT DOCUMENTS 6,923,746 B1 8/2005 Skowronski et al.
6,958,032 B1 10/2005 Smith et al.
7,090,620 B1 8/2006 Barlow
7,115,073 B2 10/2006 Nizamuddin
7,179,205 B2 2/2007 Schmidt
D562,416 S 2/2008 Fedriga et al.
D566,209 S 4/2008 Alessandri et al.
7,410,449 B2 8/2008 Yeh
7,560,822 B1 7/2009 Hoffmann
7,608,023 B2 10/2009 Casagrande
7,618,345 B2 11/2009 Corbalis et al.
7,704,191 B2 4/2010 Smith et al.
7,717,828 B2 5/2010 Simonson et al.
7,780,573 B1 8/2010 Carmein
7,789,800 B1 9/2010 Watterson et al.
7,806,805 B2 10/2010 Barufka et al.
7,837,596 B2 11/2010 Astilean
7,862,483 B2 1/2011 Hendrickson et al.
8,007,408 B1 8/2011 Moran et al.
8,007,422 B2 8/2011 Zaccherini
8,075,450 B2 12/2011 Fabbri et al.
8,206,269 B2 6/2012 Fabbri et al.
8,241,187 B2 * 8/2012 Moon ..... A63B 22/203 482/54
8,308,619 B1 11/2012 Astilean
D672,827 S 12/2012 Alessandri et al.
8,343,016 B1 1/2013 Astilean
D682,372 S 5/2013 Alessandri et al.
8,496,566 B2 7/2013 Casadei
8,512,209 B2 8/2013 Guidi et al.
8,585,561 B2 11/2013 Watt et al.
8,676,170 B2 3/2014 Porrati et al.
8,690,738 B1 4/2014 Astillian
8,734,300 B2 5/2014 Piaget et al.
8,864,627 B2 * 10/2014 Bayerlein ..... A63B 22/0235 482/2
8,876,668 B2 11/2014 Hendrickson et al.
8,920,347 B2 * 12/2014 Bayerlein ..... A63B 21/00181 601/35
8,986,169 B2 3/2015 Bayerlein et al.
9,005,085 B2 * 4/2015 Astilean ..... A63B 22/02 482/54
9,039,580 B1 5/2015 Bayerlein et al.
9,044,635 B2 6/2015 Lull
D736,866 S 8/2015 Oblamski et al.
9,192,810 B2 11/2015 Beard et al.
9,216,316 B2 12/2015 Bayerlein et al.
9,233,272 B2 1/2016 Villani et al.
9,254,409 B2 2/2016 Dalebout et al.
D751,156 S 3/2016 Tasca et al.
9,305,141 B2 4/2016 Fabrizio
9,314,667 B2 4/2016 Puerschel
9,352,188 B2 5/2016 Astilean
9,429,511 B1 * 8/2016 Kannel ..... G01N 19/02
9,498,696 B1 * 11/2016 Razon ..... A63B 71/0009
9,595,855 B2 3/2017 Asai et al.
D788,792 S 6/2017 Alessandri et al.
9,694,234 B2 7/2017 Dalebout et al.
9,713,742 B2 7/2017 Pasini et al.
9,824,110 B2 11/2017 Giudici et al.
9,914,015 B2 3/2018 Astilean et al.
9,956,450 B2 5/2018 Bayerlein et al.
9,974,997 B2 5/2018 Cei
D820,362 S 6/2018 Citterio
10,010,748 B1 7/2018 Weinstein et al.
D827,058 S 8/2018 Lisi et al.
10,143,884 B2 * 12/2018 Cei ..... A63B 23/04
D837,312 S 1/2019 Lisi et al.
10,183,191 B2 1/2019 Astilean et al.
10,293,204 B2 5/2019 Astilean et al.
10,478,666 B2 11/2019 Yoo
10,561,883 B2 2/2020 Bayerlein et al.
2001/0018917 A1 9/2001 Brain
2002/0147079 A1 10/2002 Kalnbach
2003/0148853 A1 8/2003 Alessandri et al.
2003/0186787 A1 10/2003 Wu et al.
2004/0018917 A1 1/2004 Corbalis et al.
2004/0077465 A1 4/2004 Schmidt
2004/0097341 A1 5/2004 Alessandri et al.
2004/0241631 A1 12/2004 Nizamuddin
2004/0242631 A1 12/2004 Garlich et al.
2004/0244521 A1 12/2004 Russ et al.
2005/0009668 A1 * 1/2005 Savettiere ..... A63B 22/0664 482/66
2005/0202936 A1 9/2005 Ota
2005/0209059 A1 9/2005 Crawford et al.
2005/0272562 A1 12/2005 Alessandri et al.
2006/0003871 A1 1/2006 Houghton et al.
2006/0003872 A1 1/2006 Chiles et al.
2006/0122035 A1 6/2006 Felix
2006/0287165 A1 12/2006 Pasqualin
2007/0021278 A1 1/2007 Pan et al.
2007/0027001 A1 2/2007 Alessandri et al.
2007/0054781 A1 3/2007 Blaylock
2007/0123396 A1 * 5/2007 Ellis ..... A63B 22/02 482/54
2007/0167289 A1 7/2007 Alessandri et al.
2007/0202995 A1 8/2007 Roman et al.
2007/0225130 A1 9/2007 Maffei et al.
2007/0298935 A1 12/2007 Badarneh et al.
2008/0015094 A1 1/2008 Casagrande
2008/0020907 A1 1/2008 Lin
2008/0026914 A1 * 1/2008 Chen ..... A63B 71/0622 482/4
2008/0119332 A1 5/2008 Roman
2008/0132385 A1 6/2008 Alessandri et al.
2008/0287266 A1 11/2008 Smith
2009/0062165 A1 3/2009 Denis et al.
2009/0105047 A1 4/2009 Guidi et al.
2009/0156363 A1 6/2009 Guidi et al.
2009/0170666 A1 7/2009 Chiang
2009/0215589 A1 8/2009 Schoenenberger
2009/0280960 A1 11/2009 Tian
2010/0087298 A1 4/2010 Zaccherini
2010/0216607 A1 8/2010 Mueller
2010/0222182 A1 9/2010 Park
2011/0027549 A1 2/2011 Boutaghou
2011/0048809 A1 3/2011 Duckworth et al.
2011/0266091 A1 11/2011 Taylor
2011/0275497 A1 11/2011 Lorusso
2011/0306527 A1 12/2011 Bouffet et al.
2012/0010048 A1 1/2012 Bayerlein et al.
2012/0010053 A1 1/2012 Bayerlein et al.
2012/0019973 A1 1/2012 Ehrmantraut et al.
2012/0149613 A1 6/2012 David et al.
2012/0157267 A1 6/2012 Lo
2012/0231934 A1 * 9/2012 Lo ..... A63B 22/02 482/54
2012/0264569 A1 10/2012 Escobedo et al.
2012/0270705 A1 * 10/2012 Lo ..... A63B 22/02 482/54
2013/0256064 A1 10/2013 Bongaerts et al.
2014/0011642 A1 1/2014 Astilean
2014/0080679 A1 3/2014 Bayerlein et al.
2014/0087922 A1 3/2014 Bayerlein et al.
2014/0171272 A1 6/2014 Hawkins et al.
2014/0239760 A1 8/2014 Asai et al.
2015/0119202 A1 4/2015 Hendrickson et al.
2015/0157895 A1 6/2015 Bettini
2015/0210348 A1 7/2015 Astilean
2015/0258382 A1 9/2015 Nolan et al.
2015/0306456 A1 10/2015 Pasini et al.
2015/0352400 A1 12/2015 Bayerlein et al.
2015/0367175 A1 12/2015 Alessandri et al.
2016/0023039 A1 * 1/2016 Cei ..... A63B 23/04 482/54
2016/0096064 A1 4/2016 Gatti
2016/0144224 A1 * 5/2016 Dalebout ..... A63B 22/02 482/54
2016/0144225 A1 * 5/2016 Dalebout ..... A63B 22/0285 482/54
2016/0166877 A1 * 6/2016 Cei ..... A63B 22/02 482/54

(56) References Cited

U.S. PATENT DOCUMENTS

| | | | | |
|---|---|---|---|---|
| 2016/0263429 | A1* | 9/2016 | Wagner | A63B 21/00069 |
| 2016/0296789 | A1 | 10/2016 | Astilean et al. | |
| 2016/0367851 | A1* | 12/2016 | Astilean | B62K 7/00 |
| 2017/0007886 | A1 | 1/2017 | Alessandri | |
| 2017/0113093 | A1 | 4/2017 | Bellavista et al. | |
| 2017/0128769 | A1* | 5/2017 | Long | A63B 22/0207 |
| 2017/0182356 | A1* | 6/2017 | Cei | A63B 22/0207 |
| 2017/0274248 | A1 | 9/2017 | Brown et al. | |
| 2017/0312582 | A1 | 11/2017 | Root, Jr. | |
| 2018/0014755 | A1 | 1/2018 | Alessandri et al. | |
| 2018/0104534 | A1* | 4/2018 | Erkelenz | A63B 22/02 |
| 2018/0111018 | A1* | 4/2018 | Lee | A63B 22/0285 |
| 2018/0111023 | A1 | 4/2018 | Cei et al. | |
| 2018/0229065 | A1 | 8/2018 | Leonardi et al. | |
| 2019/0054344 | A1 | 2/2019 | Athey et al. | |
| 2019/0083843 | A1 | 3/2019 | Del Monaco et al. | |
| 2019/0083844 | A1* | 3/2019 | Bayerlein | A63B 21/00069 |
| 2019/0118030 | A1* | 4/2019 | Yoo | A63B 22/0285 |
| 2019/0168067 | A1 | 6/2019 | Bates et al. | |
| 2019/0314674 | A1* | 10/2019 | Chen | A63B 22/20 |
| 2019/0374811 | A1* | 12/2019 | Bayerlein | A63B 22/02 |
| 2020/0171353 | A1* | 6/2020 | Fima | A63B 71/0622 |
| 2020/0179789 | A1* | 6/2020 | Fima | A63B 71/0054 |
| 2020/0188760 | A1 | 6/2020 | Bandini et al. | |
| 2020/0215391 | A1 | 7/2020 | Paganelli et al. | |
| 2020/0254293 | A1* | 8/2020 | Bayerlein | A63B 21/0053 |

FOREIGN PATENT DOCUMENTS

| | | | |
|---|---|---|---|
| CN | 201006229 | | 1/2008 |
| CN | 201030178 | | 3/2008 |
| CN | 201333278 | | 10/2009 |
| CN | 102309835 | A | 1/2012 |
| CN | 103656988 | A | 3/2014 |
| DE | 19922822.2 | A1 | 12/2000 |
| DE | 10 2005 009 414 | | 9/2006 |
| DE | 20-2006-005995 | | 9/2006 |
| EP | 1 466 651 | A1 | 10/2004 |
| GB | 2 223 685 | A | 4/1990 |
| JP | 03-148743 | | 6/1991 |
| JP | 3148743 | | 2/2009 |
| KR | 2009007043 | | 1/2009 |
| KR | 10-2016-0150084 | A | 12/2016 |
| WO | WO-2004/078272 | A2 | 9/2004 |
| WO | WO-2009/000014 | A1 | 12/2008 |
| WO | WO-2009/014330 | A1 | 1/2009 |
| WO | WO-2010/057238 | A2 | 5/2010 |
| WO | WO-2010/107632 | | 9/2010 |
| WO | WO-2014/160057 | | 10/2014 |
| WO | WO-2016/163680 | A1 | 10/2016 |

OTHER PUBLICATIONS

U.S. Appl. No. 05/616,951, filed Sep. 26, 1975, Schonenberger.
U.S. Appl. No. 08/152,177, filed Nov. 12, 1993, Schonenberger et al.
U.S. Appl. No. 61/280,265, filed Nov. 2, 2009, Astilean, Aurel A.
"Servo technology smooths treadmill ride", DesignNews, Apr. 8, 2002, https://www.designnews.com/automation-motion-control/servo-technology-smooths-treadmill-ride/129729584441364, 10 pages.
"Woodway Treadmill Speed/Current Relationship", 2002, 3 pages.
Andrews et al., The Effect of an 80-Minute Intermittent Running Protocol on Hamstrings Strength Abstract, NSCA Presentation, Jul. 15, 2006, 1 page.
Answer to Counterclaims filed Nov. 14, 2014 between Speedfit LLC and Aurel Astilean versus Woodway USA, Inc., 8 pages.
Astilean, Alex, YouTube Video entitled "SpeedFit—Speedboard—First Curve Prototype" retrieved from the internet at: https://www.youtube.com/watch?v=dO9h-F-JVCU on Apr. 6, 2015, 49 pages of screenshots.
Baldor, AC Servo Control Installation and Operating Manual, MN766, 2007, 247 pages.
Baldor, Series 23H, AC Servo Control Operating Manual, 1999, 138 pages.
Biodex Medical Systems, Inc., "The Biodex RTM Rehabilitation Treadmill Operation Manual", believed to have published 2002, 48 pages.
Brughelli et al., Effects of Running Velocity on Running Kinetics and Kinematics, Journal of Strength and Conditioning Research, Apr. 2011, 7 pages.
Buchheit et al., "Assessing Stride Variables and Vertical Stiffness with GPS-Embedded Accelerometers: Preliminary Insights for Monitoring of Neuromuscular Fatigue on the Field", Dec. 2015.
Chapco, Inc. and Samsara Fitness LLC's notice pursuant to 34 U.S.C. §282, Case 3:15-CV-01665-JCH, Document 310, filed Sep. 14, 2018, 4 pps.
Claim Construction Order, *Speedfit LLC and Aurel A. Astilean* v. *Woodway USA, Inc.*, Docket No. 2:13-cv-01276-KAM-AKT, Nov. 20, 2017, 23 pages.
Complaint for Declaratory Judgment of Patent Invalidity and Correction of Inventorship, *Woodway USA, Inc.* v. *Aurel A. Astilean*, Civ. Dkt. No. 2:13-cv-00681-WEC (E.D. WI), Jun. 13, 2013, 6 pages.
Coolthings, "Woodway EcoMill: A Non-Motorized Treadmill with Electronic Displays", Jun. 4, 2009, https://www.coolthings.com/woodway-ecomill-a-non-motorized-treadmill-with-electronic-displays/, 1 page.
Curvature, http://en.wikipedia.org/wiki/Curvature, Mar. 3, 2010, 1 page.
Decision and Order Denying Defendant's Motion to Dimiss or to Transfer and Staying Case Pending Decision from Eastern District New York District Court, *Woodway USA, Inc.* v. *Aurel A. Astilean*, Civ. Dkt. No. 2:13-cv-00681-WEC (E.D. WI), Dec. 18, 2013, 7 pages.
Declaration of Aurel A. Astilean filed Jun. 15, 2015 between *Speedfit LLC and Aurel Astilean* versus *Woodway USA, Inc.* and Exhibit A.
Declaration of Aurel A. Astilean, *Speedfit LLC and Aurel A. Astilean* v. *Woodway USA, Inc.*, Docket No. 2:17-cv-00768-KAM-AKT, Exhibit 1, Mar. 26, 2018, 5 pages.
Declaration of Dan Bostan filed Jun. 15, 2015 between *Speedfit LLC and Aurel Astilean* versus *Woodway USA, Inc.* and Exhibit A.
Declaration of John F. Vodopia filed Jun. 6, 2017.
Declaration of John F. Vodopia in Further Support of Plaintiffs' Motion for Leave to Amend filed Jul. 7, 2015 and Exhibits A-C.
Declaration of John F. Vodopia in Support of Plaintiffs' motion for Leave to Amend filed Jul. 7, 2017 and Exhibits A-F.
Declaration of John F. Vodopia in Support of Plaintiffs' Motion Under 35 USC 256 to Correct Inventorship of U.S. Pat. No. 8,308,619 and U.S. Pat. No. 8,342,016 filed Jun. 15, 2015 between *Speedfit LLC and Aurel Astilean* versus *Woodway USA, Inc.* and Exhibits A-H.
Declaration of Kadie M. Jelenchick filed Jul. 7, 2015 and Exhibits A-G.
Declaration of Kadie M. Jelenchick filed Jun. 15, 2015 and Exhibits A, B and E.
Declaration of Kadie M. Jelenchick filed Jun. 6, 2017.
Declaration of Matthew W. Peters, Case 2:13-cv-01276-KAM-AKT, Document 213, filed Aug. 8, 2018, 2 pps.
Declaration of Nicholas Oblamski filed Jun. 15, 2015, and Exhibit A, 11 pages.
Declaration of Nicholas Oblamski, *Speedfit LLC and Aurel A. Astilean* v. *Woodway USA, Inc.*, Docket No. 2:17-cv-00768-KAM-AKT, Exhibit 1, Mar. 26, 2018, 12 pages.
Declaration of Robert Giachetti, Case 3:15-CV-01665-JCH, Document 88-2, filed May 1, 2017, 20 pps., marked on its face as Exhibit 1.
Declaration of Thomas B. Decea filed Nov. 19, 2015 between *Speedfit LLC and Aurel Astilean* versus *Woodway USA, Inc.*
Discovery Channel, "Wreckreation Nation", Season 1, Episode 8, first aired Feb. 24, 2009, 9 pages of screenshot excerpts.
Docket Report, *Speedfit LLC and Aurel A. Astilean* v. *Douglas G. Bayerlain*, Civ. Dkt. No. 2:13-cv-01276-KAM-AKT (E.D.N.Y.), Dec. 19, 2013, 8 pages.

(56) References Cited

OTHER PUBLICATIONS

Docket Report, *Woodway USA, Inc.* v. *Aurel A. Astilean*, Civ. Dkt. No. 2:13-cv-00681-WEC (E.D. WI), Dec. 19, 2013, 3 pages.
EMS-Grivory Grivory GV-5H Black 9915 Nylon Copolymer, 50% Glass Fiber Filled, As Conditioned, believed to be publically available before Sep. 16, 2011, 2 pages.
Excerpt from U.S. Appl. No. 14/076,912, Exhibit F, *Speedfit LLC and Aurel A. Astilean* v. *Woodway USA, Inc.*, Docket No. 2:17-cv-00768-KAM-AKT, Mar. 26, 2018, 4 pages.
Expert report of Dr. Robert Giachetti, Case 3:15-CV-01665-JCH, Document 216-2, filed Apr. 5, 2018, 31 pps., marked on its face as Exhibit 2.
Expert report of James D. Whelan, P.E., report dated Aug. 26, 2015, Case 2:13-cv-01276-KAM-AKT, Document 212-2, filed Aug. 8, 2018, 19 pps., marked on its face as Exhibit 2.
Expert report of James D. Whelan, P.E., report dated Jul. 27, 2015, Case 2:13,cv-01276-KAM-AKT, Document 212-1, filed Aug. 8, 2018, 62 pps., marked on its face as Exhibit 1.
Expert report of James D. Whelan, P.E., report dated Jun. 12, 2018, 30 pps.
Expert report of James D. Whelan, P.E., report dated Sep. 28, 2018, 10 pps.
Expert Report of Kim B. Blair, Ph.D., Case 3:15-CV-01665-JCH, Document 254-7, filed Jun. 8, 2018, 135 pps., marked on its face as Exhibit 7.
First Amended Complaint (Jury Trial Demanded), *Speedfit LLC and Aurel A. Astilean* v. *Douglas G. Bayerlein*, Civ. Dkt. No. 2:13-cv-01276-KAM-AKT (E.D.N.Y.), Jun. 17, 2013, 16 pages.
First Amended Complaint filed Jun. 17, 2013 between *Speedfit LLC and Aurel Astilean* versus *Woodway USA, Inc.*, 16 pages.
Hall, The Rotary Treadwheel, available at least as early as Nov. 2011, 1 page.
HDT Expeditionary Systems, Inc., "KineAssist-MX Owner's Manual vG", 2015, 73 pages.
Hersher, Perfect Landing, http://news.harvard.edu/gazette/story/2010/01/different-strokes/, Jan. 27, 2010, 5 pages.
Hopker et al., Familiarisation and Reliability of Sprint Test Indices During Laboratory and Field Assessment, Journal of Sports Science and Medicine, Dec. 1, 2009, 5 pages.
http://www.gettyimages.com/detail/463782507, Animal treadmill c. 1872, Museum of Science and Industry, Chicago, 3 pps.
http://www.gettyimages.com/license/542395667, 1930 era treadmill, 1 page.
Integrated Performance Systems, LLC, Conditioning in a Professional Athlete Case Study, 2005, 1 page.
Integrated Performance Systems, LLC, Lower Extremity Rehabilitation & Assessment Case Study, 2005, 2 pages.
Integrated Performance Systems, LLC, Youth Athlete-Speed Training Case Study, 2005, 2 pages.
International Preliminary Report for Application No. PCT/US2010/026731, dated Sep. 29, 2011, 7 pages.
International Preliminary Report for Application No. PCT/US2010/027543, dated Sep. 29, 2011, 9 pages.
International Search Report and Written Opinion for Application No. PCT/US2010/026731, dated May 4, 2010, 8 pages.
International Search Report and Written Opinion for Application No. PCT/US2010/027543, dated May 12, 2010, 10 pages.
International Search Report and Written Opinion for International Application No. PCT/US2016/055572, dated Feb. 17, 2017, 9 pages.
International Search Report, PCT/US2017/040449, dated Oct. 11, 2017, 6 pages.
International Standard ISO 20957-6:2005(E), for Stationary training equipment—Part 6: Treadmills, additional specific safety requirements and test methods, First edition May 1, 2005, 18pps.
Introducing the New Force 3 Treadmill Advanced Analysis Package, www.fittech.com.au, believed to be publically available before Sep. 16, 2011, 3 pages.
Joint Disputed Claim filed Apr. 19, 2017 between *Speedfit LLC and Aurel Astilean* versus *Woodway USA, Inc.*, 10 pages.
Lieberman et al., Running Barefoot, Forefoot Striking & Training Tips, http://www.barefootrunning.fas.harvard.edu/5BarefootRunning&TrainingTips.html, Feb. 26, 2010, 5 pages.
Lieberman et al., Running Barefoot: Biomechanics of Foot Strike, http://www.barefootrunning.fas.harvard.edu/4BiomechanicsofFootStrike.html, Feb. 26, 2010, 6 pages.
Lieberman et al., Running Barefoot: Biomechanics of Foot Strikes & Applications to Running Barefoot or in Minimal Footwear, http://www.barefootrunning.fas.harvard.edu/index.html, Feb. 26, 2010, 2 pages.
Lieberman et al., Running Barefoot: FAQ, http://www.barefootrunning.fas.harvard.edu/6FAQ.html, Feb. 26, 2010, 3 pages.
Lieberman et al., Running Barefoot: Heel Striking & Running Shoes, http://www.barefootrunning.fas.harvard.edu/2FootStrikes&RunningShoes.html, Feb. 26, 2010, 2 pages.
Lieberman et al., Running Barefoot: Running Before the Modern Shoe, http://www.barefootrunning.fas.harvard.edu/3RunningBeforeTheModernShoe.html, Feb. 26, 2010, 4 pages.
Lieberman et al., Running Barefoot: Why Consider Foot Strike, http://www.barefootrunning.fas.harvard.edu/1WhyConsiderFootStrike.html, Feb. 26, 2010, 1 page.
Liszewski, Andrew, "EcoMill Treadmill Generates Its Own Power", Jun. 1, 2009, http://www.ohgizmo.com/2009/06/04/ecomill-treadmill-generates-its-own-power/, 1 page.
Memorandum and Order filed Dec. 28, 2016 between *Speedfit LLC and Aurel Astilean* versus *Woodway USA, Inc.*, 22 pages.
Memorandum and Order filed Oct. 10, 2014 between *Speedfit LLC and Aurel Astilean* versus *Woodway USA, Inc.*, 39 pages.
Memorandum and Order filed Oct. 19, 2015 between *Speedfit LLC and Aurel Astilean* versus *Woodway USA, Inc.*, 11 pages.
Memorandum of Law in Support of Plaintiffs' Motion for Leave to Amend the Second Amended Complaint filed Jul. 7, 2015, 13 pages.
Minute Entry and Order for Markman Hearing, dated Jun. 13, 2018, 2 pps.
Minute Entry for Proceedings on Nov. 10, 2015 and Exhibit G.
Minute Order Regarding Claim Construction, *Speedfit LLC* v. *Woodway*, Docket No. 2:17-cv-00768-KAM-AKT, Jun. 13, 2018, 2 pages.
Mitsubishi Electric, Melservo-J2 Super Series: Servo Amplifier Instruction Manual, 2007, 402 pages.
Moody, The Effects Resisted Sprint Training on Speed, Agility and Power Production in Young Athletes, believed to be publically available before Dec. 31, 2006, 5 pages.
Motion to Dismiss filed Oct. 30, 2015 and Exhibits A-H.
NASA, "Combined Operational Load Bearing External Resistance Treadmill (COLBERT)", Aug. 2009, 3 pages.
NASA, "International Space Station: Combined Operational Load Bearing External Resistance Treadmill (COLBERT)", Jul. 19, 2017, https://www.nasa.gov/mission_pages/station/research/experiments/765.html, 4 pages.
NASA, "International Space Station: Do Tread on Me", Aug. 19, 2009, https://www.nasa.gov/mission_pages/station/behindscenes/colbert_feature.html, 2 pages.
NASA, "International Space Station: Treadmill with Vibration Isolation and Stabilization System (TVIS)", May 17, 2018, https://www.nasa.gov/mission_pages/station/research/experiments/976.html, 5 pages.
NASA, "Space Shuttle Mission STS-128: Racking Up New Science", Press Kit, Aug. 2009, 116 pages.
Nexus Resin Group, 10124 Antistat, believed to be publically available before Sep. 16, 2011, 2 pages.
Notice of Motion filed Jul. 7, 2015 between *Speedfit LLC and Aurel Astilean* versus *Woodway USA, Inc.*, 2 pages.
Notice of Motion Under 35 USC 256 to Correct Inventorship of U.S. Pat. No. 8,308,619 and U.S. Pat. No. 8,342,016 filed Jun. 15, 2015 between *Speedfit LLC and Aurel Astilean* versus *Woodway USA, Inc.*, 3 pages.
Notice of Woodway USA, Inc.'s Motion for Summary Judgment of Invalidity of U.S. Pat. No. 8,308,619 and U.S. Pat. No. 8,343,016 filed Jun. 5, 2017, 9 pages.
Notice of Woodway USA, Inc.'s motion to preclude the testimony of plaintiffs' technical expert James Whelan, Case 2:13-cv-01276-KAM-AKT, Document 211, filed Aug. 8, 2018, 3 pps.

(56) References Cited

OTHER PUBLICATIONS

Opening expert report of Dr. Robert Giachetti re: invalidity of U.S. Pat. No. 8,986,169 and U.S. Pat. No. 9,039,580, Case 3:15-CV-01665-JCH, Document 216-1, filed Apr. 5, 2018, 67 pps., marked on its face as Exhibit 1.
Order Denying Motion for Reconsideration (Doc. No. 248), dated Jun. 20, 2018, 12 pps.
OSHA 1926.307, 9 pps.
Owners Manual for NordicTrack WalkFit Classic Treadmill, received on Mar. 2, 2017, 30 pps.
Owners Manual, Force 1, Nov. 29, 2007, 44 pages.
Owners Manual, Force 3, Jan. 28, 2009, 45 pages.
Owners Manual, The Force, Dec. 18, 2008, 68 pages.
Photographs of public display of Speedfit Speedboard by Woodway presented at IHRSA Tradeshow on Mar. 17, 2009, 8 pages.
Photographs produced to Woodway at least by Nov. 10, 2014 in litigation, *Speedfit LLC and Aurel A. Astilean* v. *Woodway USA, Inc.*, No. 2:13-cv-01276-KAM-AKT, 11 pages.
Plaintiff's memorandum in support of motion for summary judgment of non-infringement and invalidity on Claim 25 of U.S. Pat. No. 9,039,580, Case 3:15-CV-01665-JCH, Document 253, filed Jun. 8, 2018, 45 pps.
Plaintiff's Reply to Defendant Woodway's Answer, Affirmative Defenses and Counterclaims to Plaintiff's Second Amended Complaint filed Mar. 27, 2015, 6 pages.
Plaintiff's Reply to Defendant Woodway's Answer, Affirmative Defenses and Counter-Claims to Plaintiffs' Supplemental Complaint filed Mar. 17, 2017, 8 pages.
Plaintiff's supplemental responses and objections to defendant's first set of interrogatories, Case 2:17-cv-00768-KAM-AKT, Document 38-3, filed Mar. 14, 2018, 22 pps., marked on its face as Exhibit C.
Plaintiffs Memorandum of Law in Opposition to Woodway's Motion for Summary Judgement of Invalidity and Opening Claim Construction Brief, Cross-Motion for Summary Judgment Upholding Validity, Cross-Motion for Summary Judgment for Infringement and Motion to Extend the Page Limitation for this Memorandum filed Jun. 6, 2017, 46 pages.
Plaintiffs' Initial Claims Construction Memorandum filed Jul. 31, 2017.
Plaintiffs' Local Rule 56(a)1 statement of undisputed material facts, Case 3:15-CV-01665-JCH, Document 254, filed Jun. 8, 2018, 14 pps.
Plaintiffs' Local Rule 56(a)2 statement of facts in opposition to summary judgment, Case 3:15-CV-01665-JCH, Document 265, filed Jun. 29, 2018, 17 pps.
Plaintiffs' Memorandum of Law in further Opposition to Defendant's Motion to Dismiss Certain of Plaintiffs' Claims filed Nov. 19, 2015, 19 pages.
Plaintiffs' memorandum of law in support of their motion for partial reconsideration, Case 3:15-CV-01665-JCH, Document 249, filed May 8, 2018, 9 pps.
Plaintiffs' motion for partial reconsideration, Case 3:15-CV-01665-JCH, Document 248, filed May 7, 2018, 3 pps.
Plaintiffs' Opposition to Woodway USA, Inc.'s motion for summary judgment of infringement on Claim 25 of U.S. Pat. No. 9,039,580, Case 3:15-CV-01665-JCH, Document 264, filed Jun. 29, 2018, 35 pps.
Plaintiffs' preliminary invalidity contentions, Case 3:15-CV-01665-JCH, Document 254-16, filed Jun. 8, 2018, 205 pps., marked on its face as Exhibit 16.
Plaintiffs' preliminary non-infringement contentions, Case 3:15-cv-01165-JCH, Document 96-3, filed May 2, 2017, 56 pps.
Plaintiffs' Reply in Support of motion for partial reconsideration, Case 3:15-CV-01665-JCH, Document 251, filed May 29, 2018, 4 pps.
Plaintiffs' supplemental non-infringement contentions, Case 3:15-CV-01665-JCH, Document 98-8, filed May 2, 2017, 60 pps.
Plantar Fascia, http://en.wikipedia.org/wiki/Plantar_fascia, Mar. 3, 2010, 3 pages.
Rebuttal expert report of Kim B. Blair, Ph.D., Case 2:13-cv-01276-KAM-AKT, Document 213-3, filed Aug. 8, 2018, 24 pps., marked on its face as Exhibit C.
Reply in Opposition to D126 filed Nov. 6, 2015 and Exhibits A and B.
Reply Memorandum of Law in Further Support of Plaintiffs' Motion for Leave to Amend the Second Amended Complaint filed Jul. 7, 2015 between *Speedfit LLC and Aurel Astilean* versus *Woodway USA, Inc.*, 13 pages.
Response in Opposition re [117] First Motion to Amend Second Amended Complaint filed Jul. 7, 2015, 2 pages.
Response in Opposition to [110] Motion to Amend-Corret-Supplement filed Jun. 15, 2015, 2 pages.
Revised Answer to Counterclaims filed Dec. 12, 2014 between *Speedfit LLC and Aurel Astilean* versus *Woodway USA, Inc.*, 5 pages.
Ross et al., The Effects of Treadmill Sprint Training and Resistance Training on Maximal Running Velocity and Power, National Strength and Conditioning Association, Mar. 2009, 10 pages.
Rule 56.1 Counter-Statement by Plaintiffs Speedfit LLC, and Aurel A. Astilean filed Jun. 6, 2017, 13 pages.
Ruling Re: Plaintiffs' Motion for Summary Judgment of Non-Infringement and Invalidity (Doc. No. 252) and Woodway's Motion for Summary Judgment of Infringement (Doc. No. 255), *Chapco, Inc. and Samsara Fitness, LLC* v. *Woodway USA, Inc.*, Docket No. 3:15-cv-01665-JCH, Jul. 24, 2018, 26 pages.
Sears, Roebuck and Co., 1986 Spring Summer Centennial Edition Catalog, Jan. 1, 1985, Curved Exerciser models 1 and 2 on pp. 496 and 497.
Second Amended Complaint filed Feb. 17, 2015 between *Speedfit LLC and Aurel Astilean* versus *Woodway USA, Inc.*, 18 pages.
Sirotic et al., Physiological and Performance Test Correlates of Prolonged, High-Intensity, Intermittent Running Performance in Moderately Trained Women Team Sport Athletes, Journal of Strength and Conditioning Research, 2007, 7 pages.
Sirotic et al., The Reliability of Physiological and Performance Measures During Simulated Team-Sport Running on a Non-Motorised Treadmill, Journal of Science and Medicine in Sport, Apr. 11, 2007, 10 pages.
Soccer International, The Red Devil's in the Details, dated Jun. 2010, 4 pages.
Southern Research et al., "AIMTech Project Brief", Oct. 20, 2015, 2 pages.
Speedfit LLC's Opening Claim Construction Brief, *Speedfit LLC and Aurel A. Astilean* v. *Woodway USA, Inc.*, Docket No. 2:17-cv-00768-KAM-AKT, Mar. 26, 2018, 9 pages.
Speedfit, video produced to Woodway at least by Apr. 28, 2015 in litigation, which is submitted herewith on DVD, *Speedfit LLC and Aurel A. Astilean* v. *Woodway USA, Inc.*
Speedfit, video produced to Woodway at least by Nov. 10, 2014 in litigation, *Speedfit LLC and Aurel A. Astilean* v. *Woodway USA, Inc.*, No. 2:13-cv-01276-KAM-AKT, 21 pages of screenshot excerpts.
Speedfit, video produced to Woodway at least by Nov. 10, 2014 in litigation, *Speedfit LLC and Aurel A. Astilean* v. *Woodway USA, Inc.*, No. 2:13-cv-01276-KAM-AKT, 23 pages of screenshot excerpts.
Supplemental Complaint filed Feb. 10, 2017 between *Speedfit LLC and Aurel Astilean* versus *Woodway USA, Inc.*
Supplemental declaration of Matthew W. Peters, Case 2:13-cv-01276-KAM-AKT, Document 227, filed Aug. 8, 2018, 1 pg.
Supplemental Expert Report of Kim B. Blair, PhD., Case 3:15-CV-01665-JCH, Document 184-8, filed Mar. 16, 2018, 19 pps., marked on its face as Exhibit AA.
Supplemental rebuttal expert report of Dr. Robert Giachetti responsive to second supplemental expert report of Dr. Kim Blair dated Apr. 13, 2018, Case 3:15-CV-01665-JCH, Document 254-4, filed Jun. 8, 2018, 18 pps., marked on its face as Exhibit 4.
Supplemental rebuttal expert report of Dr. Robert Giachetti responsive to supplemental expert report of Dr. Kim Blair dated Mar. 15, 2018, dated May 14, 2018, 12 pps.
SV-M & SV-S Servies Servo Drive User Guide, 1998, 121 pages.
Tecmachine, "Sprint Club: User's Guide", believed to have published 2002, 33 pages.

(56) References Cited

OTHER PUBLICATIONS

The Australian Competition & Consumer Commission's Mandatory Safety Standard for Treadmills (Supplier Guide), 2009, 20 pps.
The Woodway Force Brochure, The Best Way to Train for Speed & Athletic Power, dated May 5, 2005, 2 pages.
Third Amended Complaint filed Oct. 23, 2015 between *Speedfit LLC and Aurel Astilean* versus *Woodway USA, Inc.* and Exhibits A-H.
Transcript of civil cause for evidentiary hearing before the Honorable Kiyo A. Matsumoto, United States District Judge, Case 2:13-cv-01276-KAM-AKT, Document 213-4, filed Aug. 8, 2018, 10 pps., marked on its face as Exhibit D.
Transcript of civil cause for evidentiary hearing before the Honorable Kiyo A. Matsumoto, United States District Judge, Case 2:13-cv-01276-KAM-AKT, Document 227-3, filed Aug. 8, 2018, 5 pps., marked on its face as Exhibit G.
Transcript of videotaped deposition of Alex Astilean taken Jul. 10, 2018 for Case 2:17-cv-00768-KAM-AKT, 75 pps.
Transcript of videotaped deposition of Dan Bostan, Case 2:13-cv-01276-KAM-AKT, Document 227-2, filed Aug. 8, 2018, 4 pps., marked on its face as Exhibit F.
Transcript of videotaped deposition of Speedfit LLC by Alex Astilean taken Jul. 10, 2018 for Case 2:17-cv-00768-KAM-AKT, 38 pps.
Video deposition transcript of James D. Whelan taken on Sep. 28, 2015, Case 2:13-cv-01276-KAM-AKT, Document 213-1, filed Aug. 8, 2018, 23 pps., marked on its face as Exhibit A.
Woodway USA, Inc., "Treadmill Owner's Manual", Oct. 2001, 56 pages.
Woodway USA, Inc., EcoMill Promotional Flyer, Oct. 18, 2011, 1 page.
Woodway USA, Inc., Owner's Manual: EcoMill Non-Motorized, Jun. 4, 2010, 35 pages.
Woodway USA, Inc.'s Amended Supplemental Counterclaims, Case 3:15-CV-01665-JCH, Document 309, filed Sep. 14, 2018, 28 pps.
Woodway USA, Inc.'s Answer, Affirmative Defenses, and Counterclaims to Plaintiffs' First Amended Complaint filed Oct. 24, 2014 and Exhibits 1 and 2.
Woodway USA, Inc.'s Answer, Affirmative Defenses, and Counterclaims to Plaintiffs' Second Amended Complaint filed Mar. 6, 2015, 17 pages.
Woodway USA, Inc.'s Answer, Affirmative Defenses, and Counterclaims to Plaintiffs' Supplemental Complaint filed Feb. 24, 2017, 18 pages.
Woodway USA, Inc.'s first supplemental responses and objections to plaintiff's first set of interrogatories (Nos. 1-7), Case 2:17-cv-00768-KAM-AKT, Document 38-1, filed Mar. 14, 2018, 18 pps., marked on its face as Exhibit A.
Woodway USA, Inc.'s List of Claim Terms to be Considered and Proposed Constructions, *Speedfit LLC and Aurel A. Astilean* v. *Woodway USA, Inc.*, Docket No. 2:17-cv-00768-KAM-AKT, Exhibit D, Mar. 26, 2018, 4 pages.
Woodway USA, Inc.'s local rule 56(a)2 statement of facts in opposition to plaintiffs' motion for summary judgment, Case 3:15-CV-01665-JCH, Document 267, filed Jun. 29, 2018, 34 pps.
Woodway USA, Inc.'s Memorandum in response to Plaintiffs' Motion for Leave to Amend the Second Amended Complaint filed Jul. 7, 2015, 16 pages.
Woodway USA, Inc.'s Memorandum in Response to Plaintiffs' Motion Under 35 USC 256 to Correct Inventorship of U.S. Pat. No. 8,308,619 and U.S. Pat. No. 8,342,016 filed Jun. 15, 2015, 20 pages.
Woodway USA, Inc.'s memorandum in support of its motion to preclude the testimony of plaintiffs' technical expert James Whelan, Case 2:13-cv-01276-KAM-AKT, Document 212, filed Aug. 8, 2018, 37 pps.
Woodway USA, Inc.'s memorandum of law in opposition to plaintiffs' motion for summary judgment of non-infringement and invalidity of Claim 25 of U.S. Pat. No. 9,039,580, Case 3:15-CV-01665-JCH, Document 266, filed Jun. 29, 2018, 42 pps.
Woodway USA, Inc.'s Memorandum of Law in Support of Its Motions for Summary Judgment of Invalidity of U.S. Pat. No. 8,308,619 and U.S. Pat. No. 8,343,016 and Opening Claim Construction Brief filed Jun. 6, 2017, 38 pages.
Woodway USA, Inc.'s motion for summary judgment of infringement of U.S. Pat. No. 9,039,580, Case 3:15-CV-01665-JCH, Document 255, filed Jun. 8, 2018, 3 pps.
Woodway USA, Inc.'s Opening Claim Construction Brief, *Speedfit LLC and Aurel A. Astilean* v. *Woodway USA, Inc.*, Docket No. 2:17-cv-00768-KAM-AKT, Mar. 26, 2018, 15 pages.
Woodway USA, Inc.'s opposition to plaintiffs' motion for partial reconsideration, Case 3:15-CV-01665-JCH, Document 250, filed May 14, 2018, 19 pps.
Woodway USA, Inc.'s Patents, *Speedfit LLC and Aurel A. Astilean* v. *Woodway USA, Inc.*, Docket No. 2:17-cv-00768-KAM-AKT, Exhibit B, Mar. 26, 2018, 3 pages.
Woodway USA, Inc.'s Reply Claim Construction Brief, *Speedfit LLC and Aurel A. Astilean* v. *Woodway USA, Inc.*, Docket No. 2:17-cv-00768-KAM-AKT, Mar. 26, 2018, 9 pages.
Woodway USA, Inc.'s reply memorandum in further support of its motion to preclude the testimony of Plaintiffs' technical expert James Whelan, Case 2:13-cv-01276-KAM-AKT, Document 226, filed Aug. 8, 2018, 16 pps.
Woodway USA, Inc.'s Reply Memorandum in Support of Its Motion to Dismiss filed Nov. 25, 2015, 24 pages.
Woodway USA, Inc.'s Responsive Claim Construction Brief filed Jul. 28, 2017, 19 pages.
Woodway, "Curve Trainer", Sep. 2, 2020, https://www.woodway.com/products/curve-trainer/, p. 1.
Woodway, "Introducing the All New EcoMill Self Powered", published to YouTube on Mar. 25, 2010, https://www.youtube.com/watch?v=NcPH92DAArc.
Woodway, Curve 3.0 Specification, May 25, 2011, 1 page.
Woodway, Curve Specification, May 24, 2011, 1 page.
Woodway, Curve Specification, May 25, 2011, 1 page.
Woodway, Curve XL Specification, May 18, 2011, 1 page.
Woodway, Force Specification, Apr. 8, 2008, 1 page.
Woodway, Force Specification, May 2, 2011, 1 page.
Woodway, Force Specification, May 2, 2012, 1 page.
Woodway's USA, Inc.'s Reply in Support of its Motion for Summary Judgment of Invalidity of U.S. Pat. No. 8,308,619 and U.S. Pat. No. 8,343,016 and Reply Claim Construction Brief filed Jun. 6, 2017, 16 pages.
Woodway's Opposition to Defendant's Notice of Motion and Motion to Dismiss Case and Transfer Litigation to EDNY, *Woodway USA, Inc.* v. *Aurel A. Astilean*, Civ. Dkt. No. 2:13-cv-00681-WERC (E.D. WI), Oct. 18, 2013, 22 pages.
Woodways USA, Inc.'s Supplemental Rule 56.1 Statement of Undisputed Material Facts and Responses to Rule 56.1 Counterstatement by Plaintiffs Speedfit LLC and Aurel A. Astilean filed Jun. 6, 2017, 20 pages.
EP Notice of Opposition for European Application No. 17738027.6 dated May 4, 2022, 32 pages.

* cited by examiner

MOTORIZED TREADMILL WITH MOTOR BRAKING MECHANISM AND METHODS OF OPERATING SAME

CROSS-REFERENCE TO RELATED PATENT APPLICATIONS

This application is a continuation of U.S. patent application Ser. No. 16/363,273, entitled "MOTORIZED TREADMILL WITH MOTOR BRAKING MECHANISM AND METHODS OF OPERATING SAME," filed Mar. 25, 2019, which is a continuation of U.S. patent application Ser. No. 15/640,180, entitled "MOTORIZED TREADMILL WITH MOTOR BRAKING MECHANISM AND METHODS OF OPERATING SAME," filed Jun. 30, 2017, which claims the benefit of and priority to U.S. Provisional Patent Application No. 62/357,765, entitled "MOTORIZED TREADMILL WITH MOTOR BRAKING MECHANISM AND METHODS OF OPERATING SAME," filed Jul. 1, 2016, all of which are incorporated herein by reference in their entireties.

This application is related to U.S. patent application Ser. No. 14/941,342, filed Nov. 13, 2015, which is a continuation of U.S. patent application Ser. No. 14/517,478, filed Oct. 17, 2014, which is a continuation of U.S. patent application Ser. No. 13/257,038, filed Sep. 16, 2011, which is a National Stage Entry of International Application No. PCT/US2010/026731, filed Mar. 9, 2010, which claims the priority and benefit of U.S. Provisional Application Ser. No. 61/161,027, filed Mar. 17, 2009, all of which are incorporated herein by reference in their entireties This application is also related to U.S. application Ser. No. 15/765,681, filed Apr. 3, 2018, which is a National Stage Entry of International Application No. PCT/US2016/055572, filed Oct. 5, 2016, which claims the benefit of and priority to U.S. Patent Application No. 62/237,990, filed Oct. 6, 2015, which is related to U.S. patent application Ser. No. 14/832,708, filed Aug. 21, 2015, which claims the benefit of priority as a continuation of U.S. patent Applicant Ser. No. 14/076,912, filed Nov. 11, 2013, which is a continuation of U.S. patent application Ser. No. 13/235,065, filed Sep. 16, 2011, which is a continuation-in-part of prior international Application No. PCT/US10/27543, filed Mar. 16, 2010, which claims priority to U.S. Provisional Application Ser. No. 61/161,027, filed Mar. 17, 2009, all of which are incorporated herein by reference in their entireties.

TECHNICAL FIELD

The present disclosure relates to treadmills. More particularly, the present disclosure relates to motorized treadmills.

BACKGROUND

Treadmills enable a person to walk, jog, or run for a relatively long distance in a limited space. Treadmills can be used for physical fitness, athlete training and therapeutic uses for the treatment of medical conditions. It should be noted that throughout this document, the term "run" and variations thereof (e.g., running, etc.) in any context is intended to include all substantially linear locomotion by a person. Examples of this linear locomotion include, but are not limited to, jogging, walking, skipping, scampering, sprinting, dashing, hopping, galloping, side stepping, shuffling etc. The bulk of the discussion herein is focused on training and physical fitness, but persons skilled in the art will understand that all of the structures and methods described herein are equally applicable in a medical therapeutic applications.

A person running generates force to propel themselves in a desired direction. To simplify this discussion, the desired direction will be designated as the forward direction. As the person's feet contact the ground (or other surface), their muscles contract and extend to apply a force to the ground that is directed generally rearward (i.e., has a vector direction substantially opposite the direction they desire to move). Keeping with Newton's third law of motion, the ground resists this rearwardly directed force from the person, resulting in the person moving forward relative to the ground at a speed related to the force they are creating. While the prior discussion relates solely to movement in the forward direction, persons skilled in the art will understand that this can mean movement in any direction, for example side to side, backward/reverse, any desired direction.

To counteract the force created by the treadmill user so that the user stays in a relatively static fore and aft position on the treadmill, a running belt of a treadmill is driven or rotated (e.g., by a motor). Thus, in operation, the running belt moves at substantially the same speed as the user, but in the opposite direction. In this way, the user remains in substantially the same relative position along the treadmill while running.

SUMMARY

One embodiment relates to a treadmill. The treadmill includes a running belt defining a non-planar running surface, and a motor operatively coupled to the running belt. According to one configuration, the treadmill is operable in plurality of operating modes to control a user experience.

Another embodiment relates to a treadmill. The treadmill includes a running belt defining a substantially planar running surface, and a motor operatively coupled to the running belt. According to one configuration, the treadmill is operable in plurality of operating modes.

Still another embodiment relates to of operating a motorized treadmill. The method includes: providing a treadmill having a running belt defining a non-planar running surface and a motor coupled to the running belt, the motor operable in a first operating mode, a second operating mode, a third operating mode, and a fourth operating mode; responsive to receiving an indication to operate the treadmill in a first operating mode, causing the motor to disengage from the running belt such that rotation of the running belt is caused solely by a user of the motorized treadmill; responsive to receiving an indication to operate the treadmill in a second operating mode, causing the motor to selectively drive rotation of the running belt in a first rotational direction and in a second rotational directional, the second rotational direction opposite the first rotational direction; responsive to receiving an indication to operate the treadmill in a third operating mode, causing the motor to output a holding torque at a predefined threshold speed value; and responsive to receiving an indication to operate the treadmill in a fourth operating mode, causing the motor to output a torque assist force, the torque assist force configured to help rotate the running belt in addition to a force applied by the user to the running belt.

DETAILED DESCRIPTION

Figure 1:
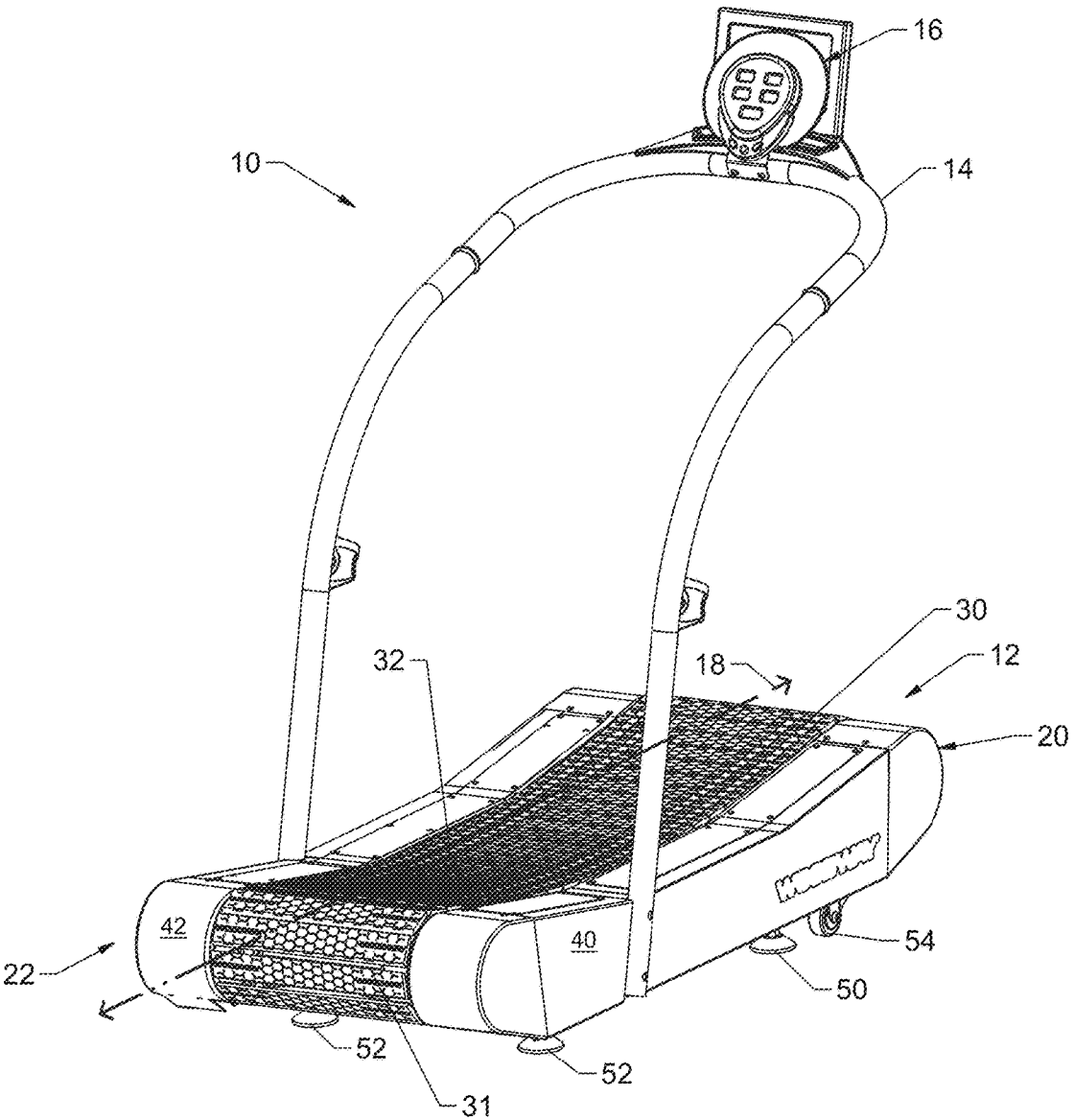
FIG. 1 is a perspective view of a treadmill having a non-planar running surface, according to an exemplary embodiment.

Referring to the Figures generally, a motorized or powered treadmill operable in a plurality of modes is disclosed according to various embodiments herein. The motorized treadmill includes a controller communicably coupled to a motor that is operatively coupled to a running belt, which defines a running surface upon which a user a may run. According to the present disclosure, the controller is structured to control or manage operation of the motor to enable operation of the treadmill in four operating modes: a non-motorized mode, a motorized mode, a brake mode, and a torque mode. In the non-motorized mode, the controller disables a holding torque of the motor to thereby allow the running belt to substantially freely rotate (i.e., the motor provides no or little resistance to the rotation or movement of the running belt such that the running belt moves substantially freely). In this regard, the treadmill may operate in a similar manner to a manually-powered treadmill (i.e., motor-less treadmill) where the speed of the running belt is dictated by a variety of factors including the gait speed of the user. In the motorized mode, the user controls the speed of the running belt by providing input to the controller and the controller in turn implements the input from the user to establish the desired running belt speed with the treadmill. For example, the user may provide a designation of 6.5 miles-per-hour (MPH), which the controller then directs the motor to cause the running belt to rotate at 6.5 MPH. In the brake mode, the controller is structured to control the motor to apply a braking force (i.e., holding torque) that resists rotational movement of the running belt caused by the user. In this regard, the user has to "fight" or "push" through the resistance exerted by the motor to cause the running belt to rotate. In the torque mode, the controller causes the motor to implement a user-defined torque setting to provide an assistive force to, in turn, cause the running belt to rotate relatively easier than, for example, in the non-motorized or brake modes of operation. In one embodiment, the treadmill may be structured as a substantially planar treadmill whereby a running belt having a running surface upon which a user may run is substantially planar in nature. In another embodiment, the treadmill is structured as a non-planar or curved treadmill whereby a running belt running surface upon which a user may run is non-planar in nature (see, e.g., FIG. 1 herein).

Beneficially, the modes of operation enable the use of a single treadmill to be adapted for use with a variety of workout types and a variety of users of varying fitness levels. For example, users who desire weight training may find the brake mode of operation desirable due to the relatively high-resistance, strength conditioning aspect of this mode of operation (i.e., the pushing or pulling of the belt to overcome a braking force exerted on the running belt). As another example, users who desire aerobic, running exercises may like the ability to manually control the speed via the non-motorized mode of operation or to run at a certain speed for a certain amount of time via the motorized mode operation. As still another example, users who may be rehabilitating an injury, just getting into a workout routine, or who simply want assistance may find the torque mode of operation desirable. In this regard, users of a variety of skills and desires may each find the treadmill of the present disclosure appealing. In this regard and advantageously, the treadmill of the present disclosure may alleviate the need for multiple types of fitness or rehabilitation equipment because of the types of rehabilitation routines or exercises that may be possible due to the modes of operation described herein. These and other features and benefits of the present disclosure are described more fully herein below.

As mentioned above, the motorized treadmill may be structured as a planar treadmill or as a non-planar treadmill. In this regard, FIGS. 1-5 depict a non-planar treadmill while FIGS. 6-13 depict a planar treadmill, according to various embodiments. Each of these treadmill embodiments are firstly described before turning to the operational modes of the treadmill.

Accordingly, referring collectively now to FIGS. 1-5, a motorized non-planar treadmill 10 is shown according to an example embodiment. As shown, the treadmill 10 includes a base 12, a handrail 14 mounted or coupled to the base 12, a display device 16 coupled to the handrail 14, a running belt 30 that extends substantially longitudinally along a longitudinal axis 18, a pair of side panels 40 and 42 (e.g., covers, shrouds, etc.) that are provided on the right and left side of the base 12, a pair of rearward positioned feet 50 (i.e., proximate the rear end 22), a pair of forward positioned feet 52 (i.e., proximate the front end 20), and a pair of wheels 54 (e.g., casters, rollers, etc.) positioned proximate the front end 20). The longitudinal axis 18 extends generally between a front end 20 and a rear end 22 of the treadmill 10; more specifically, the longitudinal axis 18 extends generally between the centerlines of a front shaft and a rear shaft, which will be discussed in more detail below. The side panels 40 and 42 may shield the user from the components or moving parts of the treadmill 10. The base 12 is supported by multiple support feet 50 and 52, while the pair of wheels 54 enable a user to grip a handle (not shown) of the base 12 to relatively easily move the treadmill 10. In use, the wheels 54 of the treadmill 10 are supported above a support surface; the wheels 54 may contact the ground to thereby permit the user to easily roll the entire treadmill 10 when desired. It should be noted that the left and right-hand sides of the treadmill and various components thereof are defined from the perspective of a forward-facing user standing on the running surface of the treadmill 10.

A number of devices, both mechanical and electrical, may be used in conjunction with or in cooperation with a treadmill 10. FIG. 1, for example, shows a display device 16 adapted to calculate and display performance data relating to operation of the treadmill 10 according to an exemplary embodiment. The display device 16 may include any type of display device including, but not limited to, touchscreen display devices, physical input devices in combination with a screen, and so on. The display device 16 may include an integrated power source (e.g., a battery), or be electrically coupleable to an external power source (e.g., via an electrical cord that may be plugged into a wall outlet). The feedback and data performance analysis from the display may include, but are not limited to, speed, time, distance, calories burned, heart rate, etc. According to other exemplary embodiments, other displays, cup holders, cargo nets, heart rate grips, arm exercisers, TV mounting devices, user worktops, and/or other devices may be incorporated into the treadmill. Further and as shown, the display device 16 may include a plurality of input devices (e.g., buttons, switches, etc.) that enable a user to provide instructions to the treadmill 10 and to control the operation thereof.

Figure 2:
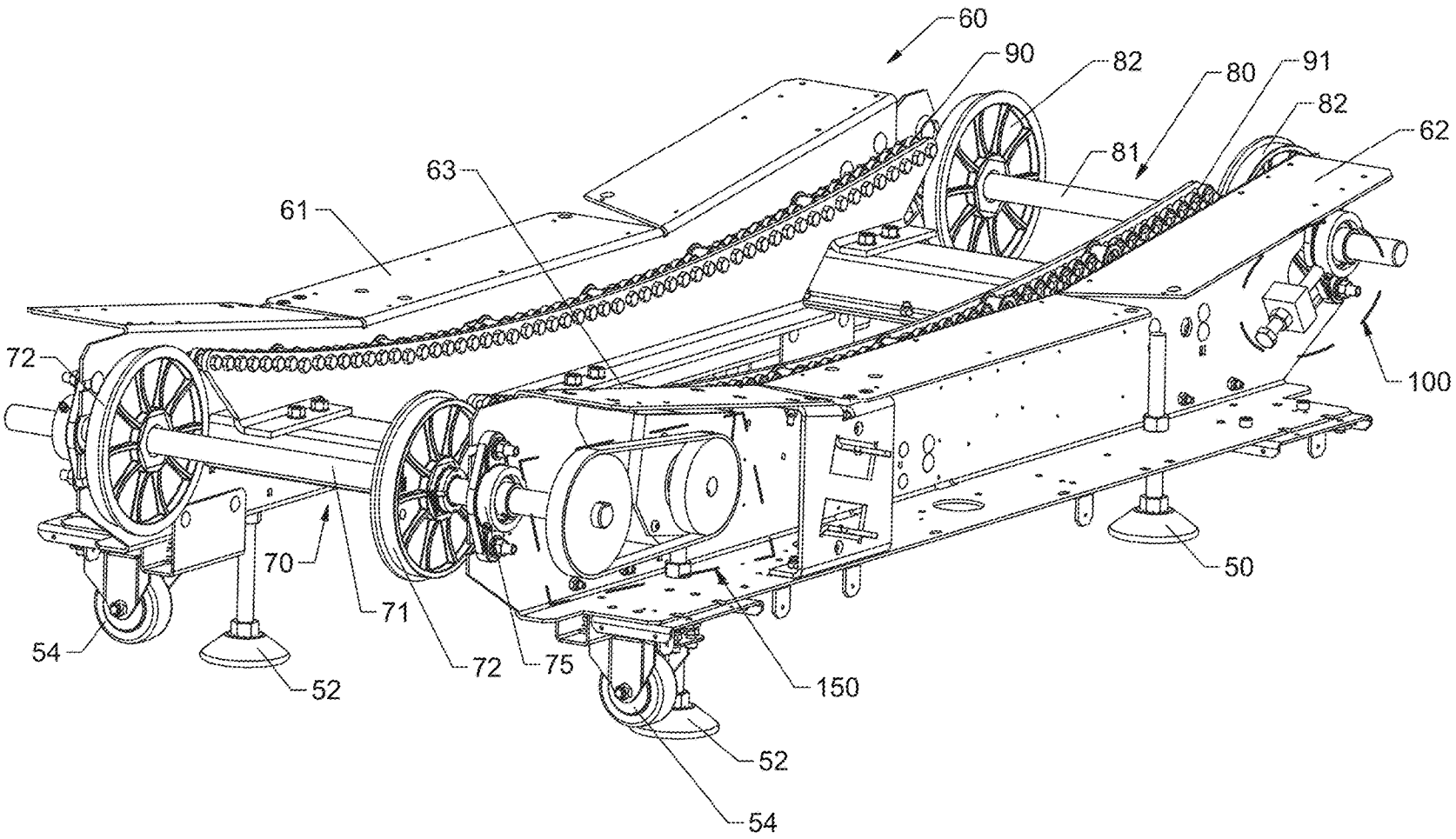
FIG. 2 is a perspective view of the treadmill of FIG. 1 with most of the coverings removed, according to an exemplary embodiment.
Figure 3:
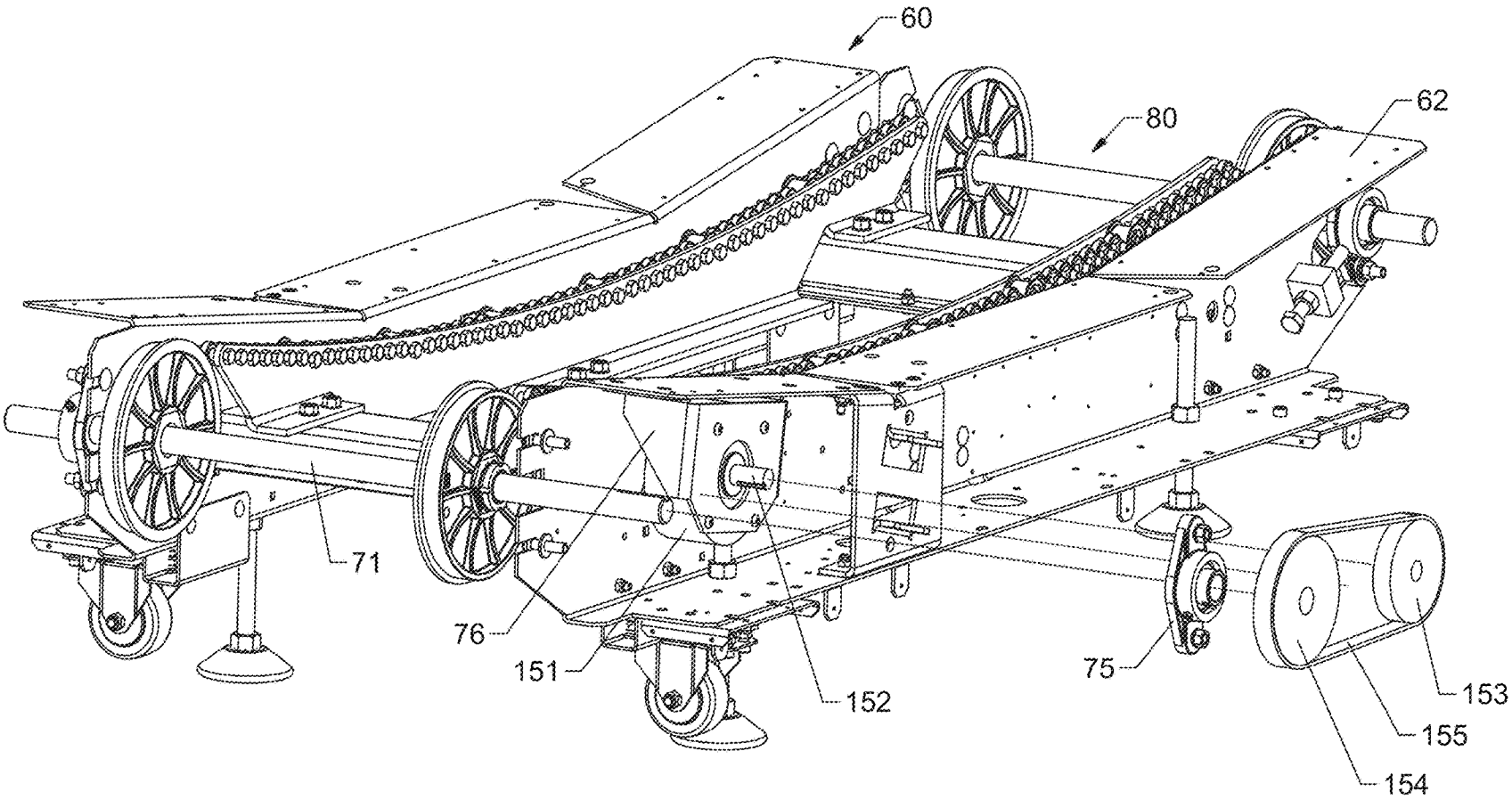
FIG. 3 is another perspective view of the treadmill of FIG. 1 with most of the coverings removed, according to an exemplary embodiment.
Figure 4:
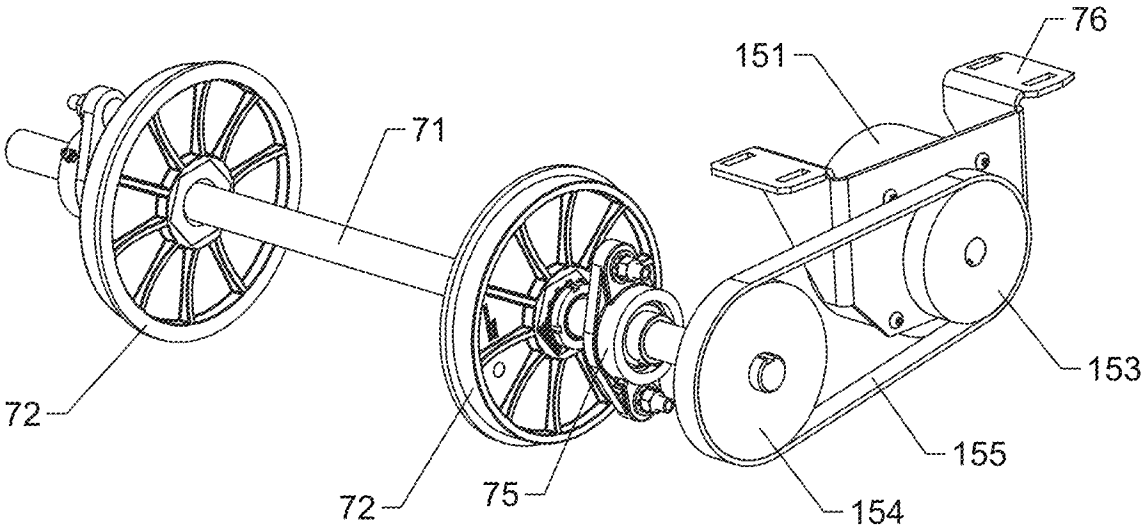
FIG. 4 is a perspective view of the motor system of the treadmill of FIG. 1, according to an exemplary embodiment.
Figure 5:
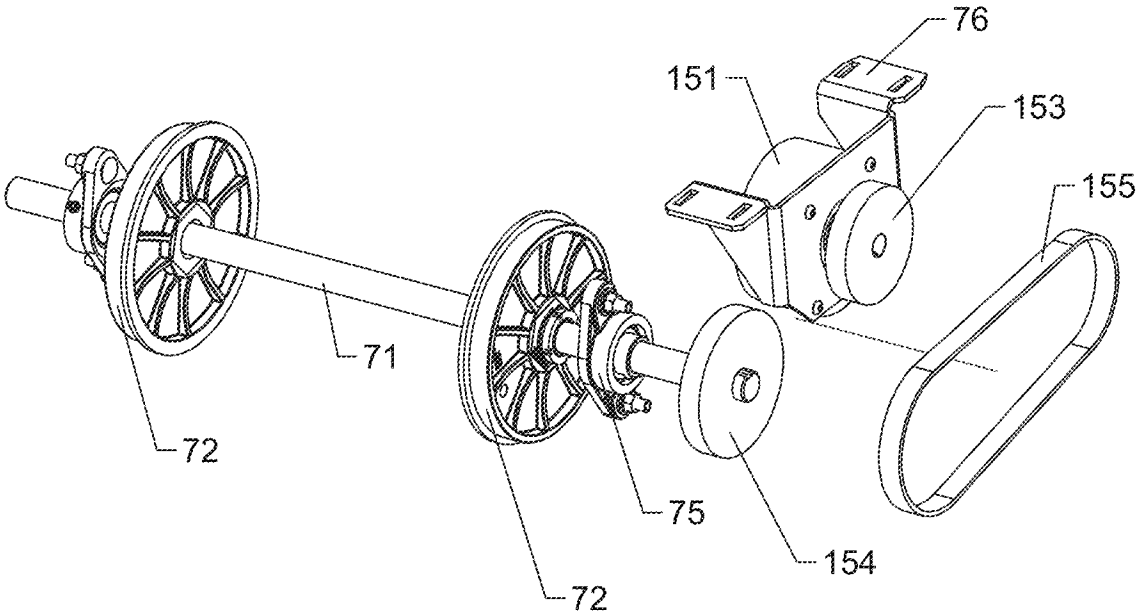
FIG. 5 is an exploded assembly view of the motor system of the treadmill of FIG. 1, according to an exemplary embodiment.
Figure 6:
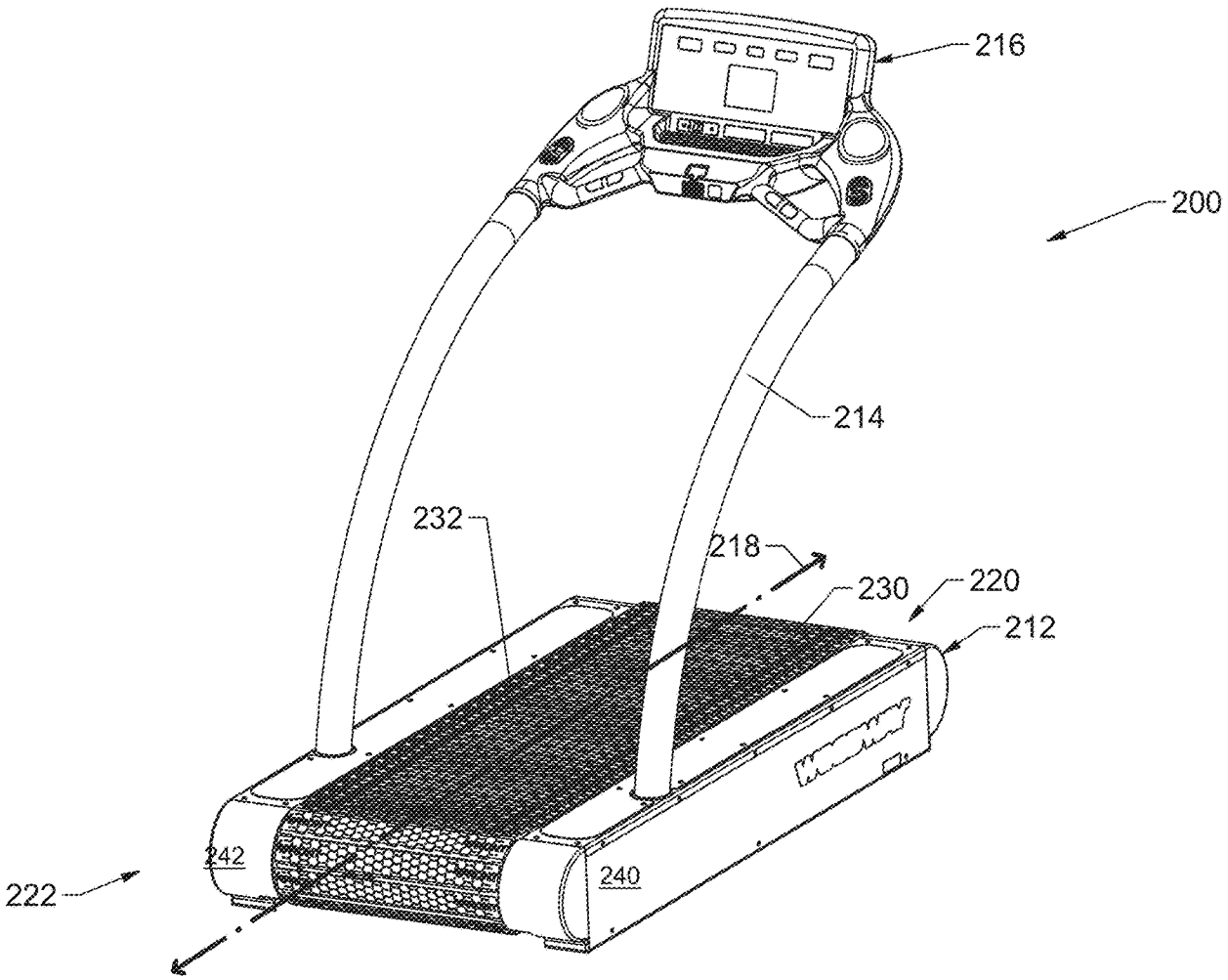
FIG. 6 is a perspective view of a treadmill having a substantially planar running surface, according to an exemplary embodiment.
Figure 7:
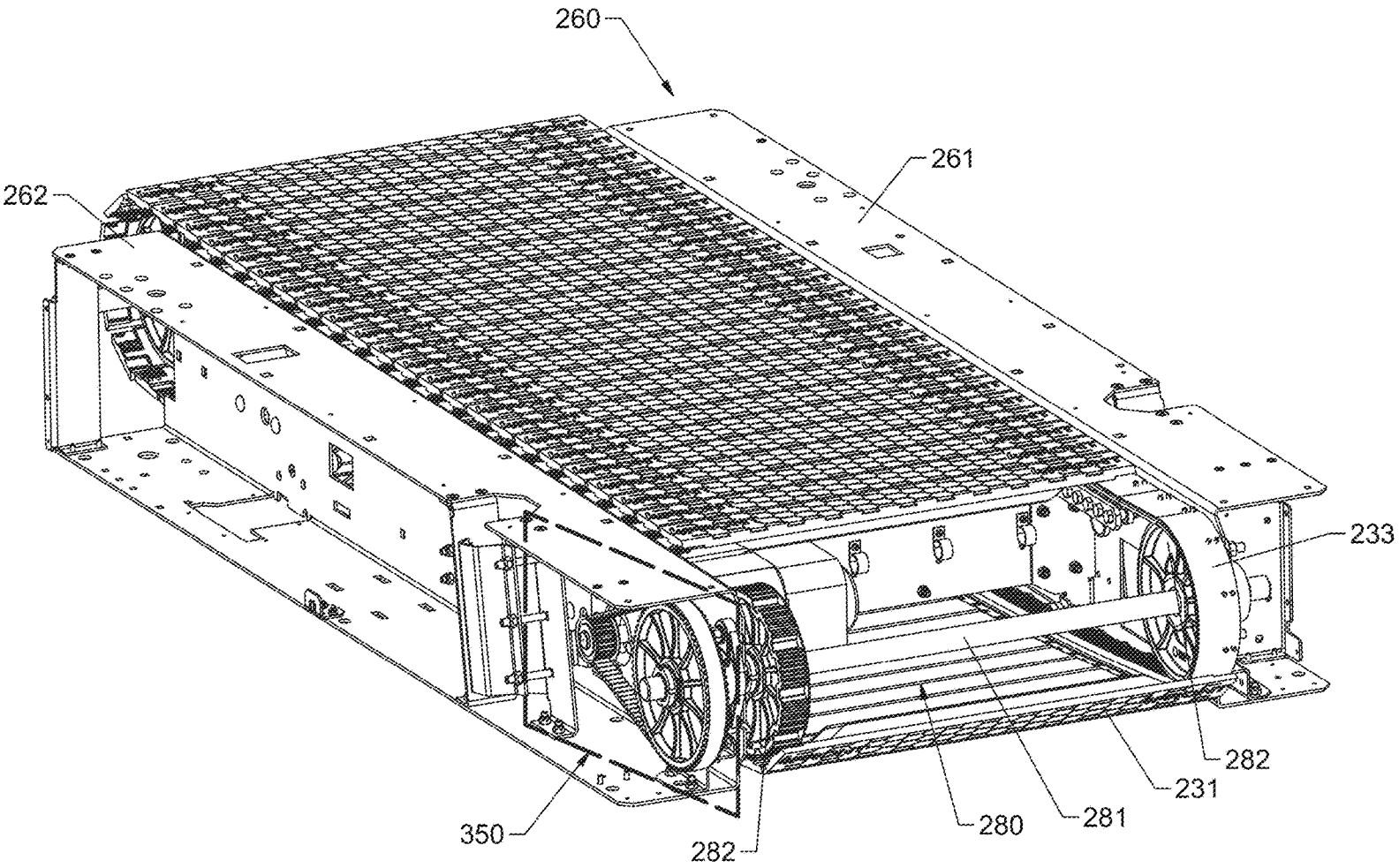
FIG. 7 is a perspective view of the treadmill of FIG. 6 with most of the coverings removed, according to an exemplary embodiment.
Figure 8:
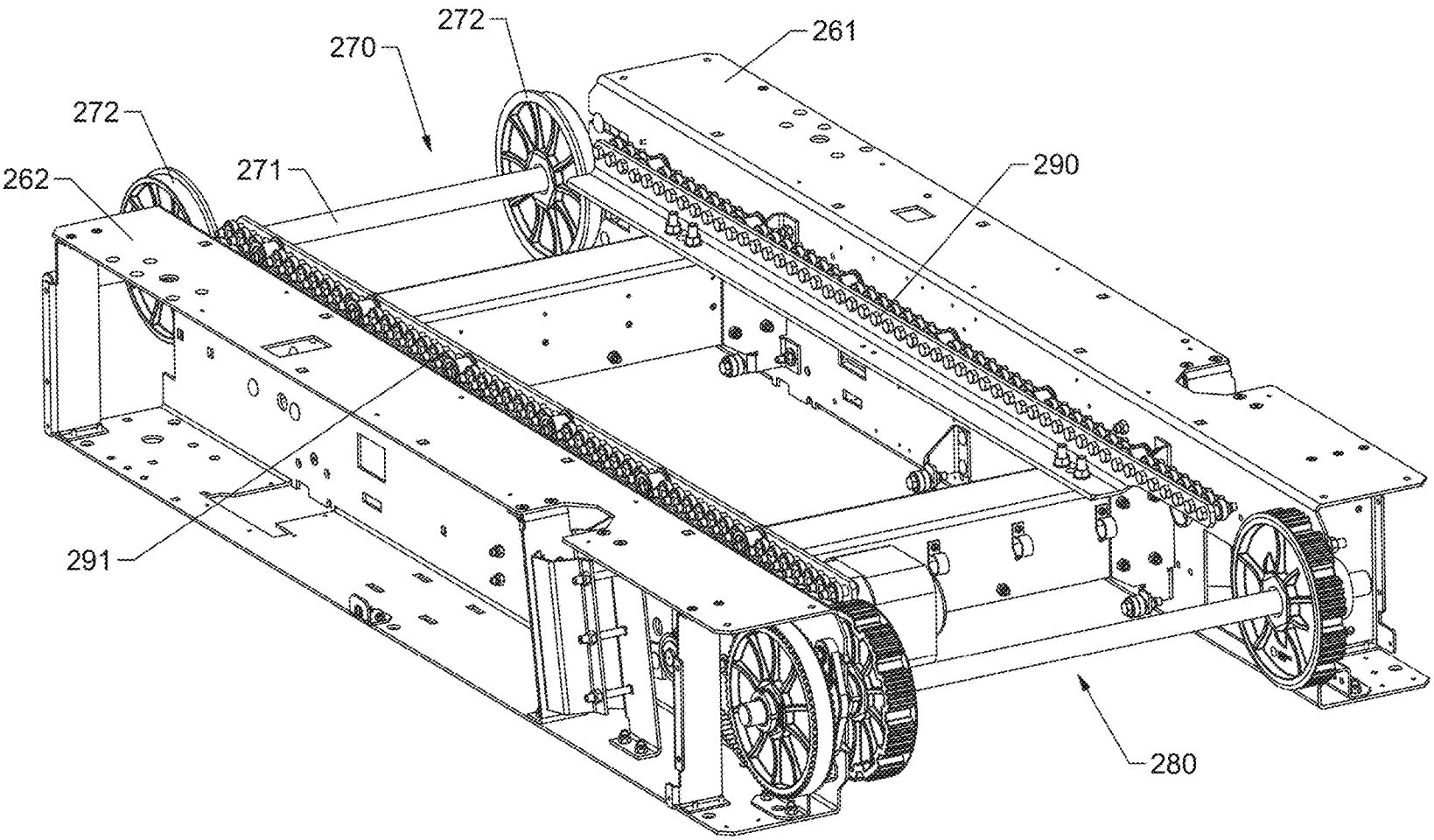
FIG. 8 is another perspective view of the treadmill of FIG. 1 with most of the coverings removed as well as the running belt, according to an exemplary embodiment.
Figure 9:
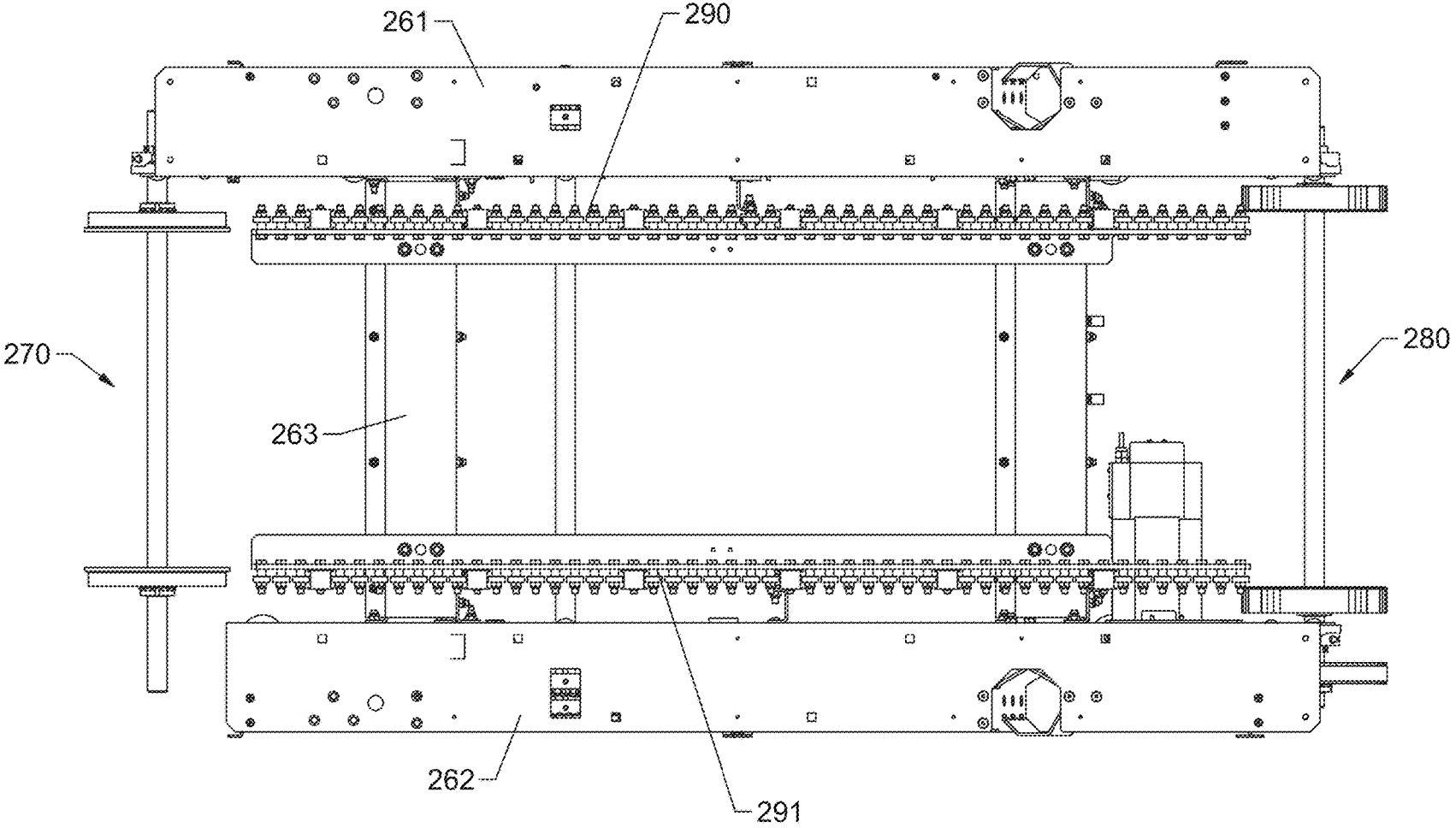
FIG. 9 is a top view of the treadmill of FIG. 8, according to an exemplary embodiment.
Figure 10:
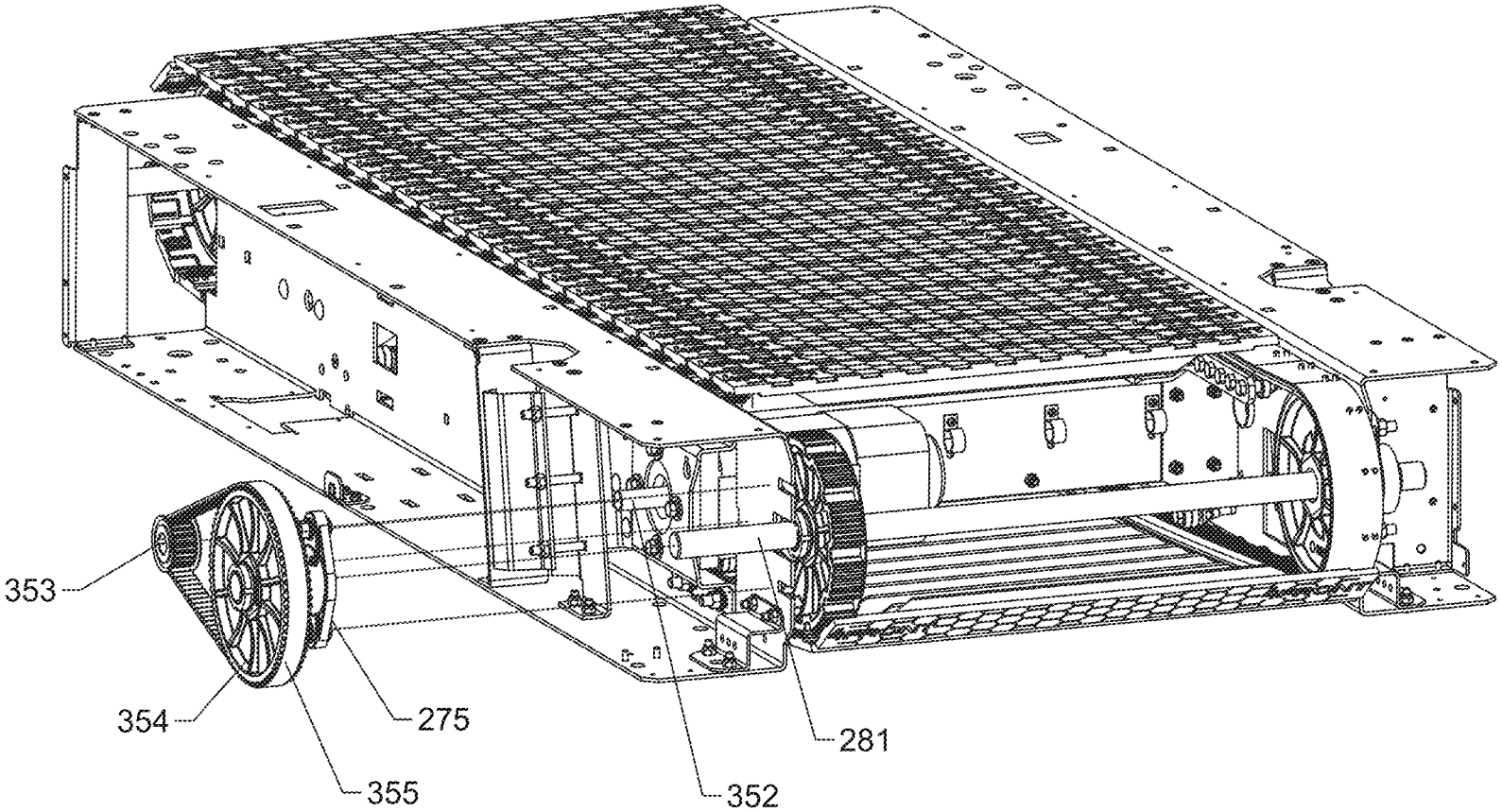
FIG. 10 is an exploded assembly perspective view of the motor system of the treadmill of FIG. 6 with most of the coverings removed, according to an exemplary embodiment.
Figure 11:
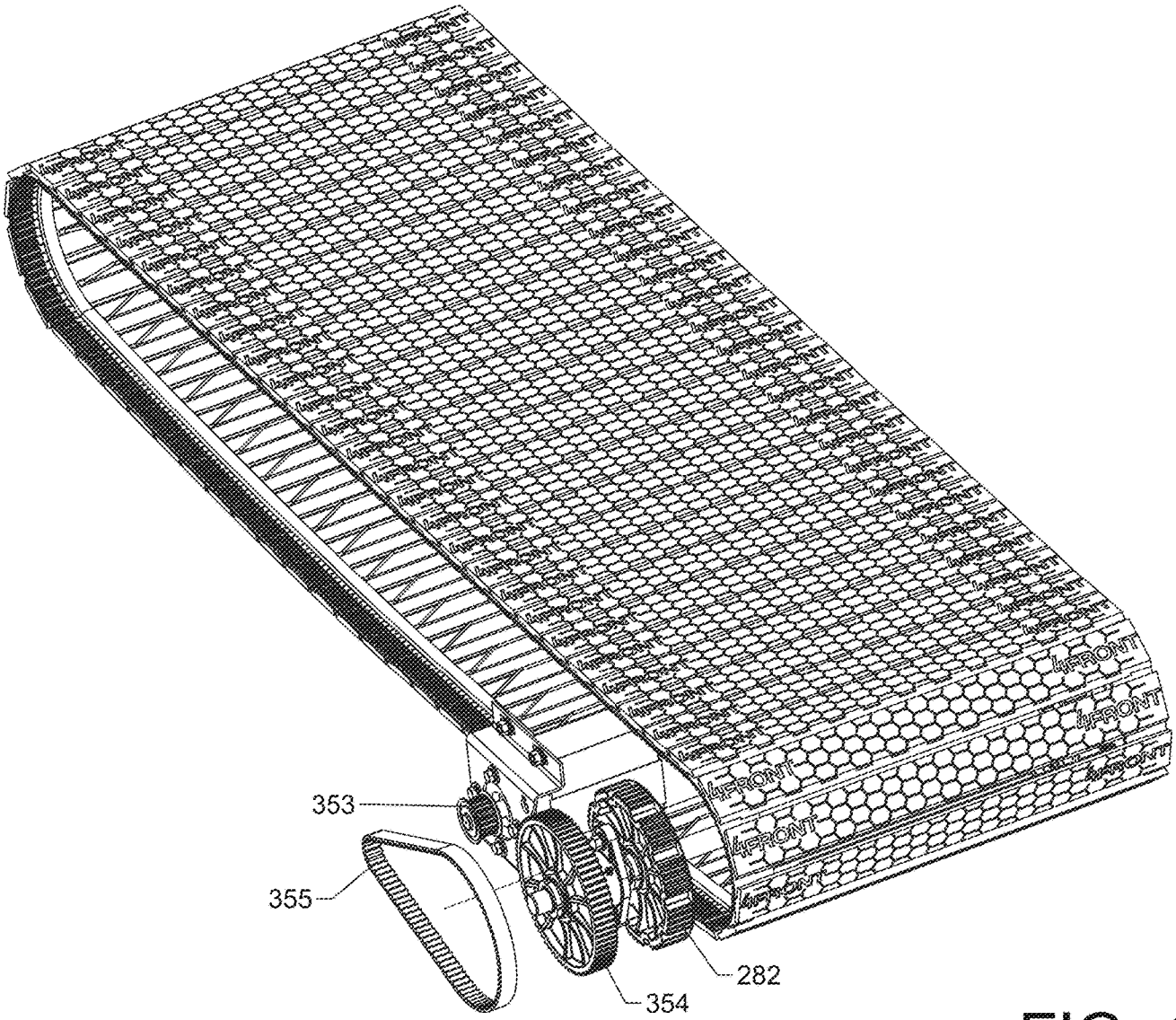
FIG. 11 is a top perspective view of the component view of the treadmill in FIG. 10, according to an exemplary embodiment.
Figure 12:
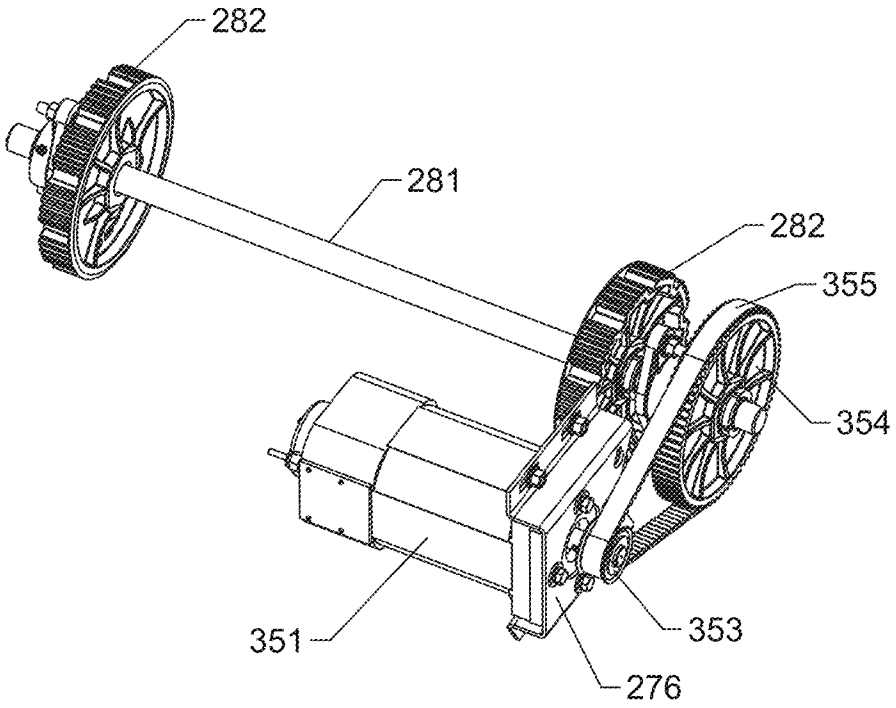
FIG. 12 is a perspective view of the motor system of the treadmill of FIG. 6, according to an exemplary embodiment.
Figure 13:
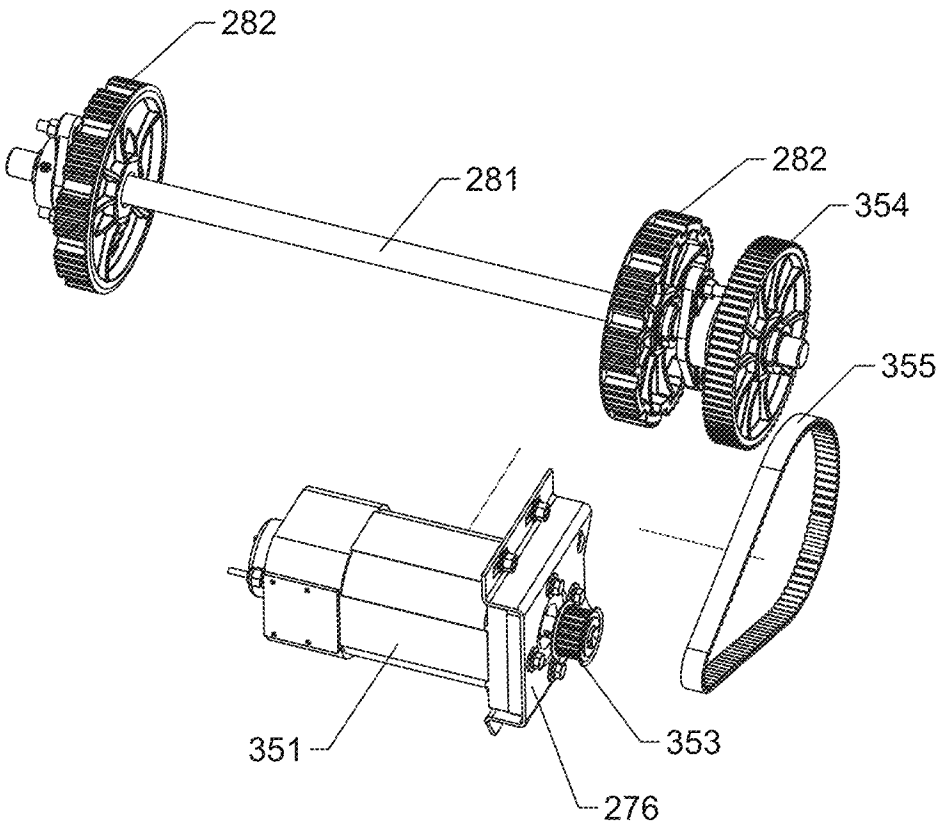
FIG. 13 is an exploded assembly view of the motor system of FIG. 12, according to an exemplary embodiment.

As shown in more detail in FIGS. 2-3, the base 12 includes a frame 60 which is an assembly of elements such as longitudinally-extending, opposing side members, shown as a right-hand side member 61 and a left hand side member 62 and one or more lateral or cross-members 63 extending between and structurally coupling the side members 61 and 62. The frame 60 is adapted to support a front shaft assembly 70 positioned near a front end 20 of the frame 60, a rear shaft assembly 80 positioned near the rear end 22 of frame 60, a plurality of bearings 90 coupled to and extending generally longitudinally along the right side member 61 of the frame 60, a plurality of bearings 91 coupled to and extending generally longitudinally along the left-hand side member 62 of the frame 60. The pluralities of bearings 90, 91 are substantially opposite each other about the longitudinal axis 18, and a tension assembly 100 coupled to the frame 60. Each of these components is described herein below.

The front shaft assembly 70 includes a pair of front running belt pulleys 72 interconnected with, and preferably directly mounted to, a shaft 71, while the rear shaft assembly 80 includes a pair of rear running belt pulleys 82 interconnected with, and preferably directly mounted to, a shaft 81. In operation, multiple bearing assemblies 75 may rotationally couple the front shaft assembly 70 and rear shaft assembly 80 to the frame 60. The bearing assemblies 75 may be structured as any type of bearing assembly configured to support and enable rotation of the shaft assemblies relative to the frame 60 (e.g., thrust bearings, etc.). The front and rear running belt pulleys 72, 82 are configured to facilitate movement/rotation of the running belt 30. As the front and rear running belt pulleys 72, 82 are preferably fixed relative to shafts 71 and 81, respectively, rotation of the front and rear running belt pulleys 72, 82 causes the shafts 71, 81 to rotate in the same direction. The front and rear running belt pulleys 72, 82 may be formed of any material sufficiently rigid and durable to maintain shape under load. According to one embodiment, the material is relatively lightweight so as to reduce the inertia of the pulleys 72, 82. The pulleys 72, 82 may be formed of any material having one or more of these characteristics (e.g., metal, ceramic, composite, plastic, etc.). According to the exemplary embodiment shown, the front and rear running belt pulleys 72, 82 are formed of a composite-based material, such as a glass-filled nylon, for example, Grivory® GV-5H Black 9915 Nylon Copolymer available from EMS-GRIVORY of Sumter, S.C. 29151, which may save cost and reduce the weight of the pulleys 72, 82 relative to metal pulleys. To prevent a static charge due to operation of the treadmill 10 from building on a pulley 72, 82 formed of electrically insulative materials (e.g., plastic, composite, etc.), an antistatic additive, for example Antistat 10124 from Nexus Resin Group of Mystic, Conn. 06355, may be may be blended with the GV-5H material. Alternatively, the pulleys 72, 82 may be formed of a relatively heavy or high mass material (e.g., metal, ceramic, composite, etc.) if it is desired to create a support structure which has a relatively high inertia as the user generates rotation of the running belt.

The pluralities of bearings 90, 91 are attached or coupled to the frame 10 and structured to support or at least partially support the running belt 30 and to facilitate movement thereof. In this regard, the pluralities of bearings 90, 91 may be arranged to facilitate a desired shape or contour of the running surface 32 of the running belt 30. More particularly, the pluralities of bearings 90, 91 may be arranged in a desired shape or contour of the running surface 32 due to how the pluralities of bearings 90, 91 are coupled to the frame 60 (e.g., in such a way to form a non-planar profile). Accordingly, the running surface 30 assumes a shape that substantially corresponds to the shape of the profile of the pluralities of the bearings 90, 91. The bearings 90, 91 are configured to rotate to thereby decrease the friction experienced by the running belt 30 as the belt moves or rotates relative to the frame 10. The tension assembly 100 may be structured to selectively adjust a position of the rear shaft assembly 80 to add, reduce, and generally control a tension applied to the belt 30. An exemplary structure of the bearings 90, 91 and tension assembly 100, components that may be included therewith, and arrangements therefor (e.g., relative positions on the treadmill) is described in U.S. patent application Ser. No. 15/765,681, filed Apr. 3, 2018, which as mentioned above is incorporated herein by reference in its entirety as well as the other listed related applications. In this regard, the tension assembly may cooperate with a slot (e.g., slot 91 of U.S. patent application Ser. No. 15/765,681) that is curve-shaped, linear-shaped, or non-linear shaped.

As shown, the running belt 30 is disposed about the front and rear running belt pulleys 72, 82, and at least partially supported by at least some of the pluralities of bearings 90, 91. The running belt 30 includes a plurality of slats 31 and defines a non-planar running surface 32 (e.g., curved running surface); hence, the "non-planar" treadmill 10. An example structure of the slats 31 and shape of the running surface 32 is described in U.S. patent application Ser. No. 15/765,681, filed Apr. 3, 2018, which as mentioned above is incorporated herein by reference in its entirety as well as the other listed related applications.

As also shown, the treadmill 10 according to the present disclosure includes a motor system 150. The motor system 150 is structured to selectively provide and not provide power or rotational force to the running belt 30 to operate the treadmill 10 in accordance with the non-motorized mode of operation, motorized mode of operation, brake mode of operation, and torque mode of operation. As shown, the motor system 150 includes a motor 151 attached or coupled to the frame 60 (particularly, the left-hand side member 62) by a bracket 76 (e.g., housing, support member, etc.). The motor 151 includes an output shaft 152, which is rotatably coupled to a drive pulley 153 that is rotatably coupled to a driven pulley 154 by a motor belt 155. As shown, the motor system 150 is in cooperation with the front shaft assembly 70. In particular, the driven pulley 154 is interconnected with (e.g., directly mounted on) the front shaft 71, such that rotation of the driven pulley 154 causes rotation of the front shaft 71 (and, in turn, the front running belt pulleys 72). However, in other embodiments, the motor system 150 may be in cooperation with the rear shaft assembly (e.g., the driven pulley may be rotationally coupled to the rear shaft) and/or multiple motor systems may be included whereby the motor systems are included in various positions with various connections to various components of the treadmill. While the present invention uses a motor belt 155 to translate the drive force/braking action of the motor to the running belt, it is to be understood that any conventional means for interconnecting the motor to the running belt including gears, chains, and the like may be used in addition to or in place of the motor belt 155.

The motor 151 may be structured as any type of motor that may be used to selectively power (e.g., impart force to or otherwise drive rotation of) the running belt 30. In this regard, the motor 151 may be an alternating current (AC) motor or a direct current (DC) motor and be of any power rating desired. In one embodiment, the motor 151 is structured as brushless DC motor in order to be able to selectively provide a driving force which is useable in the motorized mode and a holding torque, which is useable in the brake mode of operation (described in more detail herein below). Further, the motor 151 may receive electrical power from an external source (e.g., from a wall outlet) or from a power source integrated into the treadmill, such as a battery. Additionally, the motor 151 may be solely a motor or be a motor/generator combination unit (i.e., capable of generating electricity). Similarly, the drive pulley 153, driven pulley 154, and belt 155 may be structured as any type of pulley and belt combination. For example, in one embodiment, the belt 155 may be structured as a toothed belt. In another example, the belt 155 may be structured as a v-shaped belt. In yet another example, the belt 155 may be structured as a substantially smooth belt. In each configuration, the configuration of the pulleys 153, 154 may correspond (e.g., a v-shaped pulley to correspond with a v-shaped belt) with the structure of the belt 155. Moreover and as shown, the drive pulley 153 is of a relatively larger size (e.g., diameter) than the driven pulley 154. In another embodiment, the driven pulley 154 is of a relatively larger size (e.g., diameter) than the drive pulley 153. In still other embodiments, the driven pulley 154 and drive pulley 153 are of substantially similar sizes (e.g., diameters). Differing diameters of the drive pulley 153 to driven pulley 154 differs the speed differential between the two pulleys, which may be used to achieve a desired speed ratio for the treadmill 10. Thus, those of ordinary skill in the art will readily recognize and appreciate the wide variety of structural configurations of the motor system 150, with all such variations intended to fall within the scope of the present disclosure.

Before turning to operation of the motor system 150, as mentioned above, the systems and methods described herein may also be implemented with planar or substantially planar motorized treadmills. Therefore, turning now to FIGS. 6-13, a planar motorized treadmill 200 is shown according to various example embodiments. The planar motorized treadmill 200 may be substantially similar as the non-planar motorized treadmill 10 except that the running surface of the treadmill 200 is substantially planar in nature (e.g., flat, not-curved, etc.). While the incline of the running surface may change with either the treadmill 10 or treadmill 200, the characteristic planar feature of the treadmill 200 remains constant. Thus, to ease explanation of the treadmill 200, similar reference numbers are used with FIGS. 6-13 as were used in FIGS. 1-5 with the treadmill 10 except with the prefix "2" (with the notable exception of reference number 200 being used from the treadmill of FIGS. 6-13 compared to the reference number 10 for the treadmill of FIGS. 1-5). In this regard, similar reference numbers are used to denote similar components unless context indicates otherwise or unless explicitly described otherwise.

In this regard and referring collectively to FIGS. 6-13, the planar motorized treadmill 200 includes a base 212, a handrail 214 mounted or coupled to the base 212, a display device 216 coupled to the handrail 214, a running belt 230 that extends substantially longitudinally along a longitudinal axis 218, a pair of side panels 240 and 242 (e.g., covers, shrouds, etc.) that are provided on the right and left side of the base 212, and a frame 260 including a right-hand side member 261 and a left-hand side member 262 disposed substantially longitudinally opposite the right-hand side member 261. One or more cross-members, such as cross-members 263, may be used to join, couple, or otherwise connect the right-hand and left-hand side members 261, 262 together. The longitudinal axis 218 extends generally between a front end 220 and a rear end 222 of the treadmill 200. The side panels 240 and 242 may shield the user from the components or moving parts of the treadmill 200. Like the treadmill 10, it should be noted that the left and right-hand sides of the treadmill and various components thereof are defined from the perspective of a forward-facing user standing on the running surface of the treadmill 200. It should also be noted that similar support feet and wheels as described herein with respect to the treadmill 10 and in the related applications under the cross-reference to related applications section may also be included with the treadmill 200.

Like the treadmill 10, the treadmill 200 includes a pair of front running belt pulleys 272 coupled to, and preferably directly mounted to, a shaft 271, and a rear shaft assembly 280 includes a pair of rear running belt pulleys 282 coupled to, and preferably directly mounted to, a shaft 281. The front and rear running belt pulleys 272, 282 are configured to facilitate rotational movement of the running belt 230, and may be rotationally coupled to the frame 260 by multiple bearing assemblies 275. As the front and rear running belt pulleys 272, 282 are preferably fixed relative to shafts 271 and 281, respectively, rotation of the front and rear running belt pulleys 272, 282 causes the shafts 271, 281 to rotate in the same direction.

As also shown, the treadmill 200 may include a plurality of bearings 290 coupled to and extending longitudinally the right side member 261 of the frame 260, and a plurality of bearings 292 coupled to and extending longitudinally along the left-hand side member 262 of the frame 260 such that the pluralities of bearings 290, 291 are substantially opposite each other about the longitudinal axis 218. Relative to the pluralities of bearings 290, 291, the pluralities of bearings 290, 291 are arranged in a substantially planar configuration to at least partly support the running belt 230 in the substantially planar orientation/configuration.

As shown, the running belt 230 is disposed about the front and rear running belt pulleys 272, 282, and at least partially supported by the bearings 290, 291. The running belt 230 includes a plurality of slats 231 and defines a planar or substantially planar running surface 232 (e.g., non-curved running surface); hence, the "planar" treadmill 10. An example structure of the slats 231 is described in U.S. patent application Ser. No. 15/765,681, filed Apr. 3, 2018, which as mentioned above is incorporated herein by reference in its entirety as well as the other listed related applications. However, in other embodiments, the running belt 230 and running belt 30 may be constructed as an endless belt, also referred to as a closed-loop treadmill or running belt (e.g., a non-slat embodiment). As also shown, the running belt 230 includes an endless belt 233, which interfaces with or engages with a front running belt and a rear running belt pulley. Another endless belt (not shown) engages with the other front running belt pulley and rear running belt pulley. The endless belts 233 may be supported by the plurality of bearings 290, 291, respectively. Further details regarding example configurations of the endless belts 233 are provided in U.S. patent application Ser. No. 14/832,708 and related applications, which as mentioned before are incorporated herein by reference in their entireties. It should be understood that while not shown, the treadmill may incorporate an alternative to the slat belt such as an endless belt, like endless belt and described under the related applications may also be used with the running belt 30 of the non-planar treadmill 10.

Similar to the motorized treadmill 10, the treadmill 200 is motorized and includes a motor system 350. The motor system 350 is structured to selectively provide power, to not provide power, or to provide braking to resist rotational movement of the running belt 230 as the treadmill 200 operates in the non-motorized mode of operation, motorized mode of operation, brake mode of operation, and torque mode of operation. As shown, the motor system 350 includes a motor 351 attached or coupled to the frame 260 (particularly, the left-hand side member 262) by a bracket 276 (e.g., housing, support member, etc.) and has an output shaft 352, a drive pulley 353, and a driven pulley 354 coupled to the drive pulley 353 by a motor belt 355. As shown, the motor system 350 is in cooperation with the rear shaft assembly 280. In particular, the driven pulley 354 is interconnected with (e.g., directly mounted on) the rear shaft 281, such that rotation of the driven pulley 354 causes rotation of the rear shaft 281 (and, in turn, the rear running belt pulleys 282). However, in other embodiments, the motor system 350 may be in cooperation with the front shaft assembly (e.g., the driven pulley may be rotationally coupled to the rear shaft) and/or multiple motor systems may be included whereby the motor systems are included with the treadmill.

Like the motor 151, the motor 351 may be structured as any type of motor that may be used to selectively power (e.g., impart force to or otherwise drive rotation of) the running belt 230. In one embodiment, the motor 351 is structured as brushless DC motor in order to be able to selectively provide resistance to rotation of the running belt in the form of a holding torque, which is useable in the brake mode of operation (described in more detail herein below). In this regard, the motor 351 may be an alternating current (AC) motor or a direct current (DC) motor and be of any power rating desired. Thus, the motor 351 may receive electrical power from an external source (e.g., from a wall outlet) or from a power source integrated into or included within the treadmill, such as a battery. Further, the motor 351 may be solely a motor or be a motor/generator combination unit. Similarly, the drive pulley 353, driven pulley 354, and belt 355 may be structured as any type of pulley and belt combination. For example, in one embodiment and as shown, the belt 355 may be structured as a toothed belt. In another example, the belt may be structured as a v-shaped belt. In yet another example, the belt may be structured as a substantially smooth belt. In each configuration, the configuration of the pulleys 353, 354 may correspond to that of the belt 355 (e.g., a v-shaped pulley to correspond with a v-shaped belt). For example and as shown, the pulleys 353, 354 may be toothed to mesh or engage with the toothed belt 355. Moreover and as shown, the drive pulley 353 is of a relatively smaller size (e.g., diameter) than the driven pulley 354. In another embodiments, the driven pulley 354 is of a relatively greater diameter than the drive pulley 353. In still other embodiments, the driven pulley 354 and drive pulley 353 are of substantially similar diameters. Differing diameters of the drive pulley 353 to driven pulley 354 differs the speed differential between the two pulleys, which may be used to achieve a desired speed ratio for the treadmill 10. Thus, those of ordinary skill in the art will readily recognize and appreciate the wide variety of structural configurations of the motor system 350, with all such variations intended to fall within the scope of the present disclosure.

Figure 14:
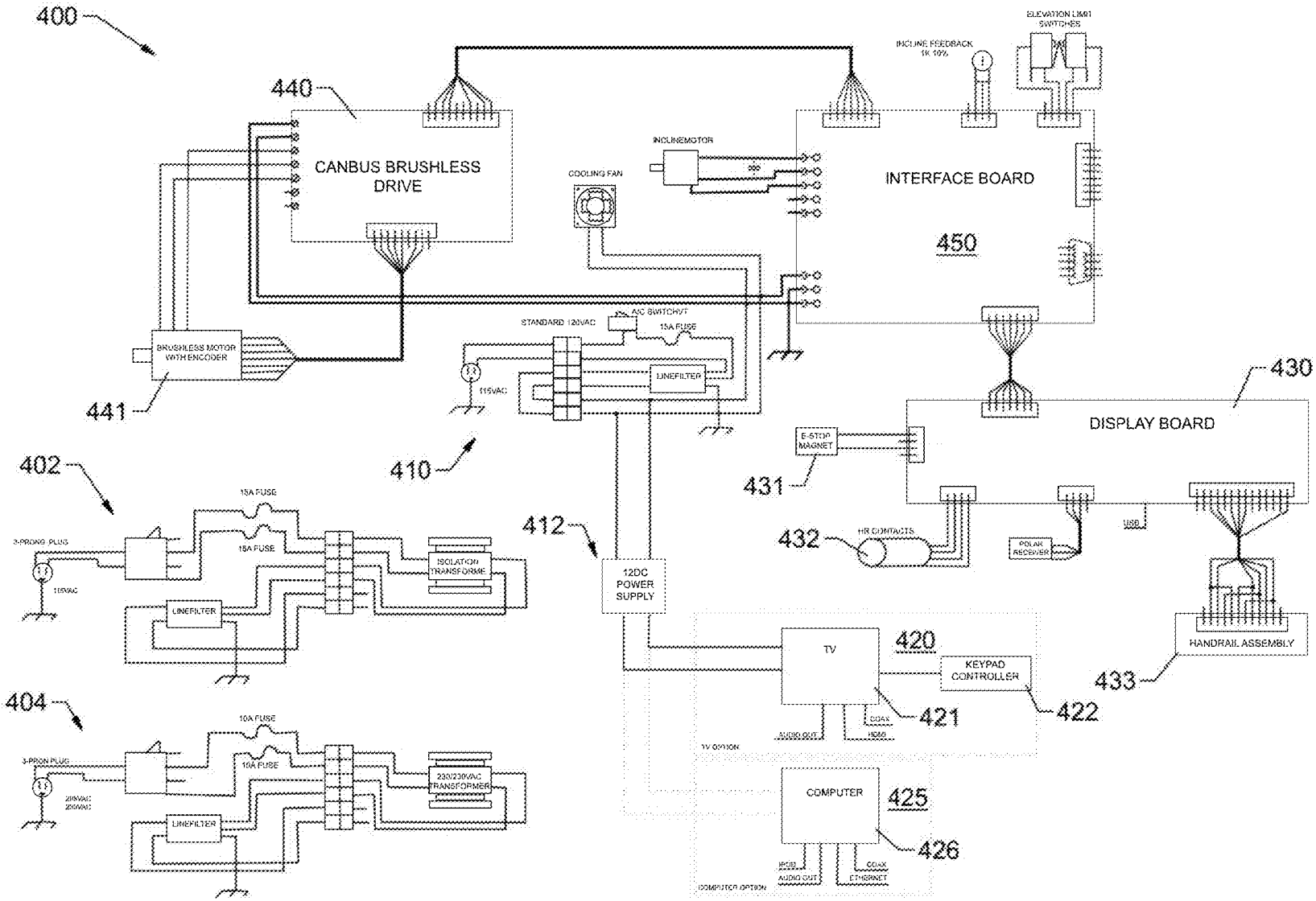
FIG. 14 is an electrical schematic diagram for the treadmill of FIG. 1 or the treadmill of FIG. 6, according to an exemplary embodiment.

Referring now to FIG. 14, a schematic diagram of an electrical system 400 useable with either treadmill 10 or treadmill 200 is shown according to an example embodiment. The electrical system 400 may be structured to control various components of the treadmill 10 and treadmill 200, track and store data regarding operation of the treadmill 10 and treadmill 200, enable the exchange of data or information between various components of the treadmill 10 and treadmill 200 (e.g., heart rate data acquired from the handrails or wirelessly), and/or otherwise control or manage the providing of electrical power to one or more components of the treadmill 10 or treadmill 200. Because the system 400 is useable with either treadmill 10 or treadmill 200, reference may be made to various components of the treadmill 10 or 200 to aid explanation. As shown, the system 400 is electrically configurable to be useable with 120 VAC or 230 VAC line voltage, as shown with input power systems 402 and 404 respectively. The input power systems 402, 404 may include an electrical cord that is electrically adapted to plug-into a wall outlet (or other electricity providing source) for receiving 120 VAC or 230 VAC, respectively. The input power systems 402, 404 are shown to include various switches, relays, transformers, and filters to modify, manage, or otherwise control the electrical power received from a power source (e.g., wall outlet). In other embodiments, only one of the input power systems 402 or 404 may be included with the treadmill. In the example shown, an input power system 410 is electrically coupleable to a 120 VAC power source (e.g., an American wall outlet) to receive 120 VAC power. The received power may be useable to drive or power one or more components of the treadmill 10 or treadmill 200.

As also shown, the system 400 includes a DC power supply 412, a television circuit 420, a computer circuit 425, a display board 430, a motor controller 440, and a controller 450 among various other components. The DC power supply 412 may be structured as any DC power supply and be independent from the AC power source (e.g., from input power system 410) or used with the AC power source by using, e.g., a rectifier to convert the AC voltage to DC voltage, like shown in FIG. 14. The DC power supply 412 may be used to power one or more DC-powered electronics, such as the television circuit 420 and computer circuit 425. The television circuit 420 is structured to provide television, over the air or through any other auxiliary means (e.g., cable or satellite), to users of the treadmill 10 or 200. In this regard, the television circuit 420 is shown to include a television 421 (e.g., display device, monitor, etc.) operatively coupled to a keypad controller 422 (e.g., remote, etc.), whereby the keypad controller 422 enables a user to control the television 421. In one embodiment, the television 421 is included with the treadmill 10 or 200. In another embodiment, the television 421 is a separate component relative to the treadmill 10 or 200, such that the television circuit 420 includes communication circuitry for coupling to the television 421. In operation, the keypad controller 422 may be disposed on the handrail 14 or 214, or any other convenient location, that enables a user to control the television 421. The computer circuit 425 is shown to include a computer 426. The computer circuit 425 is structured to facilitate the communicable coupling of the treadmill 10 or 200 to one or more computer electronics (e.g., smartphone, tablet computer, heartrate monitor, fitness tracking device, etc.) to enable the exchange of information between the one or more computer electronics and the computer circuit 425. In this regard, computer circuit 425 may include any type of electrical coupling devices or components (e.g., wireless transceivers such as a Bluetooth® transceiver, NFC transceiver, and the like, wired transceiver such as an Ethernet port or USB port, and/or any combination thereof). It should be understood that the computer circuit 425 and television circuit 420 may include any other additional and/or different components for performing the activities described herein (e.g., filters, a memory device or other storage device, one or more processors, etc.). It should also be understood that the television circuit 420 and computer circuit 425 are optional components, which may be selectively included with the treadmill 10 or treadmill 200 based on, for example, a model of the treadmill or a desire of the producer/manufacturer.

The display board 430 may be structured to enable the reception of an input from a user of the treadmill 10 or 200 and to provide outputs to the user (e.g., heart rate, distance, time duration, set speed, incline setting, resistance setting for brake operation mode, etc.). Accordingly, the display board 430 may be included with display device 16 or 216. As shown, the display board 430 is communicably and operatively coupled to a plurality of sensors and other input devices, shown as an emergency stop (e-stop) magnet 431, a heart rate contact 432, and a handrail switch assembly 433. The e-stop magnet 431 is structured to instantly or nearly instantly stop the motor 151, 351 of the treadmill 10 or 200 or, alternatively, enable power to be provided from the motor 151, 351 to the running belt 30, 230. In operation, the e-stop magnet may be selectively engageable (e.g., via magnetic force) with a magnet that is tethered to the treadmill 10, 200. When the magnetic is in contact with the e-stop magnet 431, the circuit may be closed to enable the motor 151, 351 to selectively provide power to, e.g., drive the running belt 30, 230. When the magnet is not in contact with the e-stop magnet 431, the motor 151, 351 may be disabled (e.g., prevented from driving the running belt). The heart rate contacts 432 may be structured to acquire data indicative of a heart rate or pulse of a user of the treadmill 10, 200. The hart rate contacts 432 may be disposed on the handrail 14, 214 or in any other desired location on the treadmill 10, 200. The handrail switch assembly 433 includes various switches, buttons, and the like disposed on the handrail 14, 214 that are structured to enable a user to provide one or more inputs to the treadmill 10, 200. For example, the handrail switch assembly 433 may enable a reception of a mode designation input (e.g., motorized mode, non-motorized mode, brake mode, or torque mode). As another example, the handrail switch assembly 433 may enable a reception of a speed designation for motorized mode (e.g., 7 MPH, etc.). As another example, the handrail switch assembly 433 may enable reception an incline setting (e.g., a setting that affects the incline of the treadmill relative to a support surface). As still another example, the handrail switch assembly 433 may enable reception of a resistance level in brake mode that controls the resistance a user experiences rotating the running belt 30, 230. As yet another example, the handrail switch assembly 433 may enable reception of a torque assist setting that controls the assistance force provided by the motor 151, 351 in torque mode. As still yet another example, the handrail switch assembly 433 may enable a user to observe tracked data regarding operation of the treadmill 10, 200 (e.g., heart rate, speed, duration, etc.). It should be understood that the handrail switch assembly 433 may include additional functionality beyond that mentioned above and herein, with all such additional or different functionality intended to fall within the scope of the present disclosure (e.g., turn the treadmill on or off, etc.). Further, in certain embodiments, some of the functionalities described above may be implemented via the display device 16 or 216 rather than on buttons, switches, input devices and the like disposed on the handrail 14 or 214.

As shown, the display board 430 is communicably coupled to the controller 450, which is communicably coupled to the motor controller 440, which is operatively coupled to the motor 441. In this regard, the controller 450 may serve as an intermediary between the motor controller 440 and the display board 430. In operation, the motor controller 440 may be structured to control operation of the motor 441. The motor 441 may be structured as the motor 151 when used with the treadmill 10. However, when used with the treadmill 200, the motor 441 may be structured as the motor 351. Thus, the motor 441 designation is intended to be generic to both treadmill 10 and 200 implementations. While the display board 430 and motor controller 440 are shown as separate components from the controller 450, this is for exemplary purposes only. In other embodiments, one, both, or portions thereof of the display board 430 and motor controller 440 may be included with the controller 450. In this regard and because the motor controller 440 may be included with the controller 450, or because the controller 450 may provide one or more instructions to the motor controller 440 to control operation of the motor 441, or because the controller 450 may directly control the motor 441 (e.g., a direct instruction to the motor 441 from the controller 450), explanation herein may be in regard to the controller 450 performing various activities. However and based on the foregoing, it should be understood that execution of such activities may be direct (e.g., the controller 450 directly controlling the motor 441) or indirect (e.g., the controller 450 providing a command to the motor 440 to control the motor 441) with all such variations intended to fall within the scope of the present disclosure.

Accordingly and among various activities, the controller 450 may be structured to control implementation and operation of the operating modes for the treadmill 10 or treadmill 200. To accomplish these activities, the controller 450 may be structured as a variety of different types of controllers with one or more of a variety of components. For example, the controller 450 may include one or more processing circuits including one or more processors communicably coupled to one or more memory devices. The one or more processors may be implemented as any type of processor including an application specific integrated circuit (ASIC), one or more field programmable gate arrays (FPGAs), a digital signal processor (DSP), a group of processing components, or other suitable electronic processing components. The one or more memory devices (e.g., NVRAM, RAM, ROM, Flash Memory, hard disk storage, etc.) may store data and/or computer code for facilitating the various processes described herein. Thus, the one or more memory devices may be communicably connected to the one or more processors and provide computer code or instructions for executing the processes described in regard to the controller 450 herein. Moreover, the one or more memory devices may be or include tangible, non-transient volatile memory or non-volatile memory. Accordingly, the one or more memory devices may include database components, object code components, script components, or any other type of information structure for supporting the various activities and information structures described herein.

One such example activity of the controller 450 includes adjustment of a relative incline of the treadmill 10 or treadmill 200. For example, and as shown, the controller 450 is coupled to an incline motor 460. The incline motor 460 is structured to adjust a relative incline of the treadmill 10 or treadmill 200 by moving, e.g., an extension of the support feet from the treadmill 10 or treadmill 200. An example structure and configuration of the incline motor 460 and various related components and the functionalities associated therewith is described in U.S. patent application Ser. No. 14/832,708, which as mentioned above is incorporated herein by reference in its entirety along with the various other related applications. Further and as also shown, the controller 450 may be communicably to one or more sensors, such as incline feedback sensor and elevation limit switch that may define boundaries of the allowable relative incline for the treadmill 10 or treadmill 200.

As mentioned above and another such example activity of the controller 450 includes implementation of and control of the operating modes of the treadmill 10 and 200 described herein. In this regard and as shown in the example of FIG. 14, the controller 450 may provide instructions, directly or indirectly (e.g., via the motor controller 440) to control and implement the various operating modes of the treadmill 10 or treadmill 200.

Figure 15:
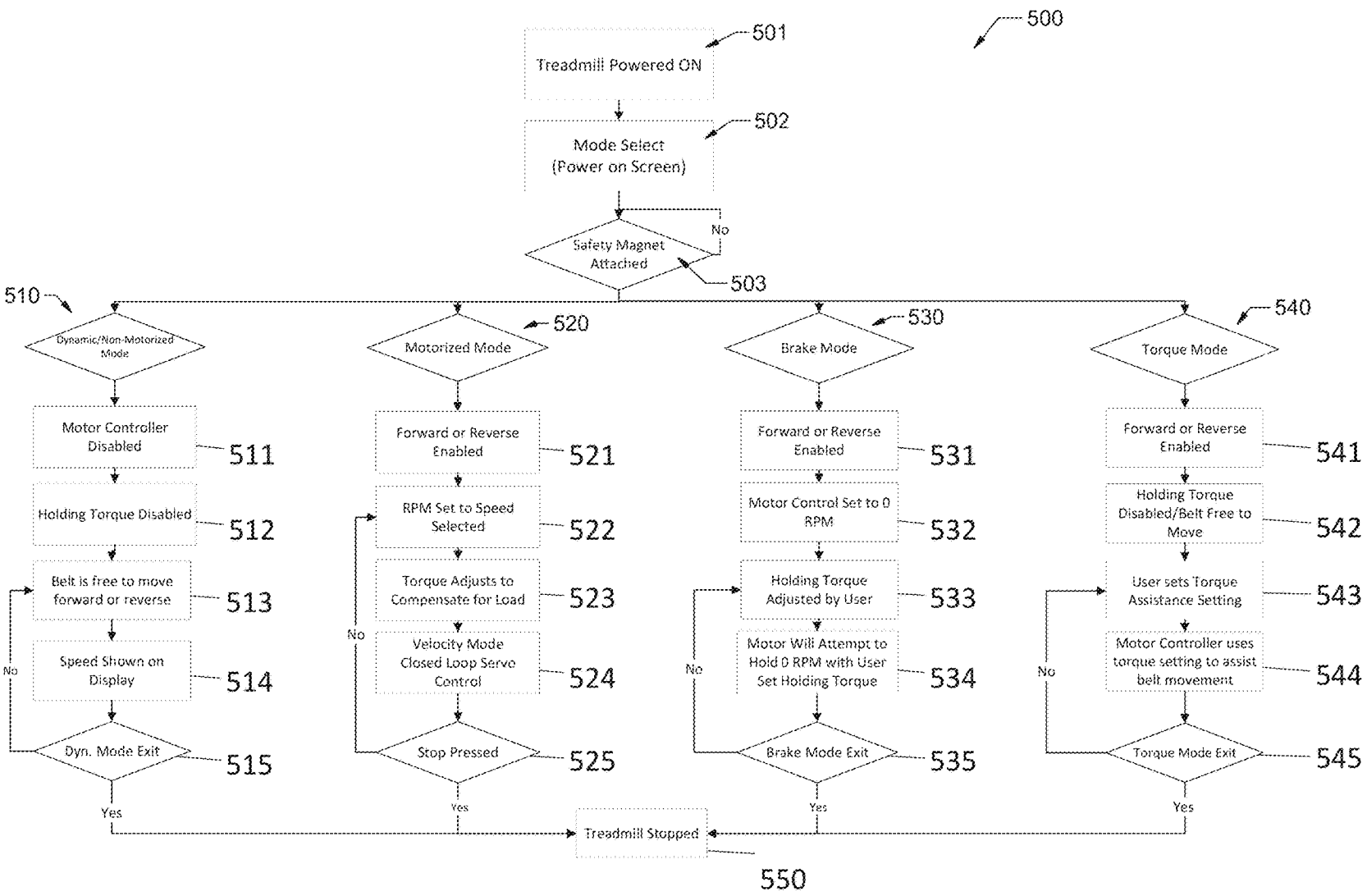
FIG. 15 is a flow diagram of operating the treadmill of FIG. 1 or the treadmill of FIG. 6 using the electrical schematic diagram of FIG. 14, according to an exemplary embodiment.

Before turning to an example control methodology for selectively controlling implementation of the operating modes as shown in FIG. 15, it should be understood that the electrical system 400 useable with either the treadmill 10 or treadmill 200 is exemplary only. In other embodiments, more, less, or different components may be included with the electrical system for one or both of the treadmills 10, 200. For example, in other embodiments, various additional filtering components may be used that smooth out and reduce noise in the exchange of data among and between the components. In another example, various additional sensors relative to the heart rate contacts 432 may also be implemented, such as a weight sensor structured to acquire data indicative of a weight of a user. Thus, those of ordinary skill in the art will appreciate and recognize that the system 400 is not meant to be limiting as the present disclosure contemplates additional configurations that are intended to fall within the scope of the present disclosure.

Referring now to FIG. 15, an example control methodology for implementing various operating modes with a motorized treadmill is shown according to an example embodiment. Because the method 500 may be implemented with the treadmill 10 or treadmill 200, reference may be made to one or more components of the treadmill 10 or 200 to aid explanation.

At process 501, data indicative of powering a treadmill on is received. In other words, process 501 refers to turning the treadmill 10 or treadmill 200 on. Data indicative of turning the treadmill on may be based on an explicit user input, such as an "ON" button on the handrail switch assembly 433. Additionally or alternatively, data indicative of turning the treadmill on may be based on a determination of the controller 450. For example, weight data indicative of a user standing on the treadmill for more than a threshold amount of time may indicate use or potential use of the treadmill and turn the treadmill on. In another example, the user may begin to use the treadmill whereby movement of the running belt 30 or 230 causes the treadmill to turn ON.

At process 502, a mode selection is received. Upon a powering on of the treadmill 10 or 200, the display device 16 or 216 presents an option to the user asking them to select in which mode to operate the treadmill 10 or 200. As mentioned above, the operation modes include: a non-motorized mode, a motorized mode, a brake mode, and a torque mode. As also mentioned above, in the non-motorized mode, the controller 450 disables a holding torque of the motor 151 or 351 to thereby allow the running belt 30 or 230 to substantially freely rotate (i.e., the motor provides no or little resistance to the rotational movement of the running belt). In the motorized mode, the controller 450 receives a running belt 30 or 230 speed designation from a user and implements that running belt speed with the treadmill 10 or 200. For example, the user may designate 6.5 miles-per-hour (MPH), which the controller 450 then implements with the motor to cause the running belt to rotate at 6.5 MPH. In this regard, the controller 450 may include one or more formulas, algorithms, processes, look-up tables, and the like for converting a user defined speed to a motor 151 or 351 rotational speed. In the brake mode, the controller 450 is structured to control the motor 151 or 351 to apply a braking force that resists rotational movement of the running belt 30 or 230 caused by the user. In this regard, the user has to "fight" or "push" through the resistance exerted by the motor 151 or 351 to cause the running belt 30 or 230 to rotate. The brake mode may be desired by users who want to strength train by increasing the resistance they experience in moving or turning the belt 30 or 230. In the torque mode, the controller 450 causes the motor 151 or 351 to implement a user-defined torque setting to provide an assistive force for the user to, in turn, cause the running belt 30 or 230 to rotate relatively easier than, for example, in the non-motorized or brake modes of operation. Each of these modes are explained in more detail below.

At process 503, data regarding a secondary triggering mechanism is received. In one embodiment, the secondary triggering mechanism refers to the e-stop magnet 432. In this regard, the data received by the controller 450 is indicative of the e-stop magnet 432 being in contact with a magnet to close the loop or circuit to, in turn, enable power output from the motor 151 or 351. In another embodiment, the triggering mechanism may refer to any other type of additional mechanism, relative to the ON/OFF mechanism of process 501, to confirm that the user wants to move forward with using the treadmill 10 or treadmill 200. In other embodiments, process 503 may be omitted from the method 500.

In response to receiving an indication that the user desires to operate the treadmill 10 or treadmill 200 in the non-motorized operation mode, process 510 is initiated. The non-motorized operation mode includes processes 511-515, which are explained herein below.

At process 511, the non-motorized operation mode includes disabling a motor controller. Thus, in this example, the motor controller 441 is a separate component relative to the controller 450, such that the controller 450 may provide an instruction to the motor controller 440 to disable (e.g., turn off, disengage, etc.). In other embodiments and as mentioned above, the motor controller 440 may be included with the controller 450 such that the controller 450 may selectively disable the motor controller component. In yet other embodiments, the motor controller may be removed from the system and the controller 450 is structured to perform the activities described herein of the motor controller 440, such that the controller 450 can directly control the motor 151 or 351. All such variations are intended to fall within the scope of the present disclosure.

At process 512, a holding torque of the motor is disabled. The "holding torque" refers to the force or torque applied by the motor 151 or 351 to the running belt. When the holding torque or force is disabled, the running belt 30 or 230 is allowed to freely rotate. In this regard, the motor 151 or 351 does not or substantially does not apply a torque to the front shaft assembly 70 of the treadmill 10 or to the rear shaft assembly 280 of the treadmill 200. In this regard, these shaft assemblies (e.g., the pulleys coupled thereto) may substantially freely rotate without having to overcome a force provided by the motor 151 or 351.

At process 513, the running belt is free to rotate. As depicted in process 513, the running belt 30 or running belt 230 is free to rotate in a forward direction or in a reverse direction. In this regard, the user can operate the treadmill 10 or treadmill 200 in a direction where their strides move them towards the display device 16 or 216 despite remaining substantially longitudinally static due to the movement of the belt (i.e., the forward direction). Or, the user can face away from the display device 16 or 216 and walk, run, jog, etc. away from the display device 16 or 216 (e.g., the user's back faces the display device)(i.e., the reverse direction). For the sake of clarity, the forward direction corresponds with the running belt 30 rotating counterclockwise based on the view point depicted in FIG. 1 while the reverse direction corresponds with the running belt 30 rotating clockwise based on the viewpoint depicted in FIG. 1. Because the running belt 30 or 230 is free to rotate in each direction, in another embodiment, the user may orient themselves along the longitudinal axis 18 or 218 such that their feet are substantially perpendicularly oriented relative to the display device 16 or 216. In this case, the user can perform slides or shuffles (e.g., basketball lane slides) in either of the forward and reverse directions. Thus, a wide variety of exercises, rehabilitation exercises, and routines are applicable with the treadmill 10 or treadmill 200 due to the capability of forward and reverse running belt 30 or 230 directional rotation capability. It should be understood that in other embodiments, a one-way directional device, such as explained and described in U.S. patent application Ser. No. 14/832,708 and related applications that as mentioned above are incorporated herein by reference in their entireties may be included with the treadmill 10 or treadmill 200. In this regard, the one-way directional device (e.g., a one-way bearing) may cooperate with at least one of the front and rear shaft assemblies of the treadmill 10 or treadmill 200 to substantially only permit rotation of at least one of the front and rear shaft assemblies in only one direction (e.g., only the forward direction or only the reverse direction).

At process 514, a speed value may be provided to the user. The "speed value" refers to a speed that the user is utilizing the treadmill 10 or treadmill 200 at (e.g., 3 MPH, etc.). In this regard, the "speed" may be provided to the display device 16 or 216 to enable the user to see how fast he/she is causing the treadmill 10 or treadmill 200 to be operated in this non-motorized mode of operation. Of course, process 514 can also include the providing of any type of data to the user via the display device 16 or 216 (e.g., a heartrate determination, time duration, an incline of treadmill, etc.). Thus, process 514 is not meant to be limiting to only the providing of speed values.

At process 515, an exit command is determined to be received. The "exit command" refers to any type of command or instruction received by the treadmill 10 or treadmill 200 that causes the operation mode (in this case, the non-motorized operation mode) to end. For example, a user may provide an explicit instruction via the display device 16 or 216 or the handrail switch assembly 433 ending their workout or injury rehabilitation routine. As another example, a user may simply stop moving, which causes the running belt 30 or 230 to stop moving (because in non-motorized mode of operation the running belt 30 or 230 is driven by the user) and provides an indication after a threshold amount of time that the user has ended use of the treadmill 10 or 200. If the exit command is determined to be received by the controller 450, the treadmill 10 or 200 is stopped (process 550). This may include turning various powered electronics off (e.g., display devices) to conserve energy. If the exit command is determined to not be received by the controller 450, the treadmill 10 or 200 may continue operating in the designated mode of operation.

In response to receiving an indication that the user desires to operate the treadmill 10 or treadmill 200 in the motorized operation mode, process 520 is initiated. The motorized operation mode includes processes 521-525, which are explained herein below.

At process 521, a forward or reverse belt rotation mode designation is received. As mentioned above and in this embodiment, the running belt 30 or 230 is rotatable in either the counterclockwise direction (i.e., forward direction) or clockwise direction (i.e., reverse direction)(based on the viewpoint of FIG. 1). In this regard and because this mode of operation corresponds with the motor 151 or 351 at least partly driving the running belt 30 or 230, the motor 151 or 351 is structured to be able to rotate in each direction. However, in other embodiments (e.g., when a one-way directional device is utilized) when the running belt 30 or 230 is only capable of rotating one direction, a different type of motor may be used that only corresponds with that rotation direction. Thus, a variety of configurations are possible with all such configurations intended to fall within the scope of the present disclosure. Upon designation of the forward or reverse belt rotation direction, the controller 450 provides a command to cause or eventually cause the motor 151 or 351 to operate in a direction that corresponds with the chosen or designated belt rotation direction.

At process 522, a speed selection is received. In this regard, the controller 450, via the display device 16 or 216 and/or through the handrail switch assembly 433, receives an indication of a desired speed of the running belt 30 or 230 in the designated direction of process 521 (e.g., 5 MPH, etc.). This selection may correspond with the controller 450 directly or indirectly through the motor controller 440 varying the current to the motor 151 or 351 to control the speed of the motor 151 or 351 in accord with the selected speed.

At process 523, an adjustment to a motor torque is selectively implemented based on a load on the treadmill. The "load" on the treadmill refers to the force that the user is imparting to the belt to at least partly cause the running belt to rotate. However, this load may be different than the force applied by the motor 151 or 351 in causing the running belt 30 or 230 to rotate at the selected speed of process 522. For example, if the user is imparting a relatively greater force to the running belt than the torque provided by the motor, the running belt may slip relative to the at least one of the front and rear running belt pulleys. Thus, at process 523, the controller 450 may control the torque output of the motor 151 or motor 351 to compensate for the load applied to the treadmill to prevent or substantially prevent various undesired circumstances, such as slippage of the running belt. As a result and in use, a relatively smoother operation characteristic may be experienced.

At process 524, speed of the running belt is monitored and compared relative to the selected speed. In this regard, the controller 450 may utilized a closed-loop control technique that monitors the speed to ensure or substantially ensure the speed is at or about the selected speed.

At process 525, an exit command is determined to be received. As mentioned above, the "exit command" refers to any type of command or instruction received by the treadmill 10 or treadmill 200 that causes the operation mode (in this case, the motorized operation mode) to end. For example, the exit command may be an explicit instruction received from the user (e.g., the pressing of a stop button, the removal of the magnet from contacting the e-stop magnet contact, etc.). Or, as another example, the exit command may be an implicit instruction. For example, the user may have stepped off the treadmill, however the motor is still causing the running belt to rotate at substantially the selected speed in the designated direction. To prevent continued operation, a weight sensor may acquire data indicative that no load or weight is being applied to the running belt (or a weight or load below a certain predefined threshold) for a predefined amount of time and then turn the treadmill off. Such an action may be a back-up to the explicit instruction action. Like mentioned above in process 510, if the exit command is determined to be received by the controller 450, the treadmill 10 or 200 is stopped (process 550). This may include turning various powered electronics off (e.g., display devices) to conserve energy. If the exit command is determined to not be received by the controller 450, the treadmill 10 or 200 may continue operating in the designated mode of operation.

In response to receiving an indication that the user desires to operate the treadmill 10 or treadmill 200 in the brake mode of operation, process 530 is initiated. The brake mode of operation includes processes 531-535, which are explained herein below.

At process 531, a forward or reverse belt rotation mode designation is received. In this regard, process 531 is analogous to process 521.

At process 532, a motor speed is set to a threshold value. In one embodiment, the threshold value is zero revolutions-per-minute (RPM). In another embodiment, the threshold value is another value corresponding to less than a selected running belt rotation speed. In this regard, the controller 450 controls the motor 151 or 351 to not rotate (when at zero RPM) to not or substantially not drive or move the running belt 30 or 230.

At process 533, a holding torque of the motor is adjusted. The holding torque refers to the torque required or sufficient for rotating the output shaft of the motor while the motor stays energized. In this regard, the holding torque represents the resistance or braking force applied to the running belt 30 or 230 that may make rotation of the running belt difficult or comparably easier. Thus, the holding torque can be increased or decreased, whereby increasing the holding torque increases the torque required to rotate the output shaft of the motor (e.g., increases a resistance experienced by a user in moving the running belt) and decreasing the holding torque decreases the torque required to rotate the output shaft of the motor (e.g., reduces a resistance experienced by a user in moving the running belt). In operation, a holding torque level (e.g., an indicator such as a numerical value, or a scale value (1/10), etc.) may be presented to a user on the display device 16 or 216. In response, the user may, via the handrail switch assembly 433 or one or more buttons on the display device 16 or 216 increase or decrease the holding torque. As a result, the force or load imparted by the user onto the running belt 30 or 230 that is required to rotate the running belt 30 or 230 in the designated direction may vary to affect the resistance experienced by the user. For example, a user who desires a high resistance workout may increase the holding torque to a maximum amount or near maximum amount. In comparison, a user who desires a relatively low resistance workout may decrease the holding torque to a relatively low value. In each instance, the user must overcome the holding torque to cause the running belt 30 or 230 rotate in the designated direction.

At process 534, the motor maintains the threshold value of motor speed in response to the adjusted holding torque. For example, the motor 151 or 351 may continue to hold the output shaft at zero RPM yet adjust the torque output to correspond with the designated holding torque level or value. Due to the characteristics of the motor 151 or 351 (e.g., the brushless DC motor shown in FIG. as 441), the torque and speed of the motor may be related. As such, there may be variance in the threshold value of motor speed in response to adjustment of the holding torque. In any event, by holding the motor speed to a low value (e.g., zero RPM), the motor 151 or 351 substantially does not drive the running belt 30 or 230. Rather, the user drives the running belt by overcoming the holding torque of the motor 151 or 351 to cause rotation or movement. Such a characteristic may be beneficial for users seeking to strength train.

At process 535, an exit command is determined to be received. As mentioned above, the "exit command" refers to any type of command or instruction received by the treadmill 10 or treadmill 200 that causes the operation mode (in this case, the brake mode of operation) to end. Process 535 may be substantially similar to process 525, such that the same, similar, additional, or different explicit and implicit data may be used to determine whether an exit command was received. If the exit command is determined to be received by the controller 450, the treadmill 10 or 200 is stopped (process 550). This may include turning various powered electronics off (e.g., display devices) to conserve energy. If the exit command is determined to not be received by the controller 450, the treadmill 10 or 200 may continue operating in the designated mode of operation.

In response to receiving an indication that the user desires to operate the treadmill 10 or treadmill 200 in the torque mode of operation, process 540 is initiated. The torque mode of operation includes processes 541-545, which are explained herein below.

At process 541, a forward or reverse belt rotation mode designation is received. In this regard, process 541 is analogous to processes 521 and 531.

At process 542, a holding torque of the motor is disabled. In this regard, the controller 450 either directly or through the motor controller 440 provides a command to disable the holding torque. In this regard, the output shaft 152 of the motor 151 and output shaft 352 of the motor 351 are free to rotate. As such, no or little resistance from the motor 151 or motor 351 is being provided to the shaft assemblies and, in turn, to the running belt 30 and 230. Therefore, the running belt 30 and 230 is substantially able to freely rotate in the designated rotation direction.

At process 543, a torque assistance setting is received. The "torque assistance setting" refers to a value, setting, indicator, etc. used to control a torque output from the motor. In this regard, a higher torque assistance setting may correspond with a higher torque output from the motor (up to a maximum or substantial maximum amount per the specifications of the motor). The torque assistance setting may be received from a user via the display device 16 or 216 or via the handrail switch assembly 433. As an example, up/down arrows may be provided on the display device 16 or 216 whereby a user can adjust the torque assistance setting by moving the up/down arrows. In operation and based on the received torque assistance setting, motor 151 or 351 provides a torque output in the corresponding designated running belt 30 or 230 designated direction (process 544). The torque output helps or aids the user rotate the running belt 30 or 230. Such an action reduces the effort required of the user to operate the treadmill 10 or 200 (i.e., move the running belt 30 or 230). Therefore, such an action may be appealing to those rehabilitating injuries, elderly users, fitness beginners, and the like.

At process 545, an exit command is determined to be received. As mentioned above, the "exit command" refers to any type of command or instruction received by the treadmill 10 or treadmill 200 that causes the operation mode (in this case, the torque mode of operation) to end. Process 545 may be substantially similar to process 535, such that the same, similar, additional, or different explicit and implicit data may be used to determine whether an exit command was received. If the exit command is determined to be received by the controller 450, the treadmill 10 or 200 is stopped (process 550). This may include turning various powered electronics off (e.g., display devices) to conserve energy. If the exit command is determined to not be received by the controller 450, the treadmill 10 or 200 may continue operating in the designated mode of operation.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and are considered to be within the scope of the disclosure.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

For the purpose of this disclosure, the term "coupled" means the joining of two members directly or indirectly to one another. Such joining may be stationary or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It should be noted that the orientation of various elements may differ according to other exemplary embodiments and that such variations are intended to be encompassed by the present disclosure.

It is important to note that the constructions and arrangements of the manual treadmill as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

What is claimed:

1. A treadmill, comprising:

a frame;

a running belt configured to rotate relative to the frame; and a motor coupled to the running belt, the motor operable in a plurality of user controlled operating modes such that:

in a first operating mode, the force of rotation of the running belt is provided by a user of the treadmill;

in a second operating mode, the motor applies a desired braking force to resist rotation of the running belt; and in a third operating mode, the motor applies a torque output to the running belt based on a force exerted on the running belt by a user of the treadmill.

2. The treadmill of claim 1, wherein in the second operating mode, the rotation of the running belt is resisted by the desired braking force in one of a first rotational direction of the running belt or in a second rotational directional of the running belt, the second rotational direction being opposite the first rotational direction.

3. The treadmill of claim 1, further comprising a front running belt pulley coupled to the frame and a rear running belt pulley coupled to the frame, the front running belt pulley and rear running belt pulley each adapted to at least partially support the running belt.

4. The treadmill of claim 1, wherein the running belt defines a substantially planar running surface.

5. The treadmill of claim 1, wherein the running belt defines a non-planar running surface.

6. The treadmill of claim 1, wherein the desired braking force is a user definable setting, wherein increasing the desired braking force increases a force required by the user to rotate the running belt and decreasing the desired braking force decreases a force required by the user to rotate the running belt.

7. A treadmill, comprising:

a running belt; and a motor coupled to the running belt, the motor operable in a plurality of operating modes such that:

in a first operating mode, the motor applies a desired braking force to resist rotation of the running belt; and in a second operating mode, the motor applies a torque output to the running belt based on a force exerted on the running belt by a user of the treadmill.

8. The treadmill of claim 7, wherein the motor is operable in a third operating mode, wherein in the third operating mode, rotation of the running belt is provided solely by a user of the treadmill.

9. The treadmill of claim 8, wherein in the third operating mode, a holding torque of the motor is disabled to allow the running belt to freely or substantially freely rotate.

10. The treadmill of claim 9, wherein in the third operating mode, the running belt moves in a first rotational direction or in a second rotational directional, the second rotational direction being opposite the first rotational direction.

11. The treadmill of claim 7, wherein in the second operating mode, the motor rotates the running belt at a desired speed and applies the torque output to compensate for a load applied to the running belt by the user of the treadmill.

12. The treadmill of claim 7, further comprising a controller coupled to the motor, wherein in the first operating mode, the controller is configured to receive an exit command to exit the first operating mode, and wherein in the second operating mode, the controller is configured to receive an exit command to exit the second operating mode.

13. The treadmill of claim 7, further comprising:

a frame;

a front shaft assembly coupled to the frame; and a rear shaft assembly coupled to the frame and spaced apart from the front shaft assembly;

wherein the running belt is disposed about the front and rear shaft assemblies.

14. The treadmill of claim 13, wherein the motor is coupled to the front shaft assembly, and wherein in the first operating mode, the desired braking force provided by the motor is applied to the front shaft assembly.

15. The treadmill of claim 13, wherein the motor is coupled to the rear shaft assembly, and wherein in the second operating mode, the desired braking force provided by the motor is applied to the rear shaft assembly.

16. The treadmill of claim 7, wherein the running belt defines a non-planar running surface.

17. The treadmill of claim 7, wherein the running belt defines a substantially planar running surface.

18. A treadmill, comprising:

a frame;

a running belt coupled to the frame and adapted to move relative to the frame; and a motor coupled to the running belt, the motor operable in a plurality of operating modes such that:

in a first operating mode, rotation of the running belt is driven by a user of the treadmill; and in a second operating mode, the motor rotates the running belt at a desired speed and selectively applies a torque output to compensate for a load applied to the running belt by a user of the treadmill.

19. The treadmill of claim 18, wherein in a third operating mode, the motor applies a desired braking force to resist rotation of the running belt.

20. The treadmill of claim 18, wherein the running belt defines a substantially planar running surface.

* * * * *